US006840013B2

(12) United States Patent
South

(10) Patent No.: US 6,840,013 B2
(45) Date of Patent: Jan. 11, 2005

(54) BUILDING WITH FOAM CORED RIBS AND METHOD

(75) Inventor: Phillip Barry South, Menan, ID (US)

(73) Assignee: Dome Technology, Inc., Idaho Falls, ID (US)

( * ) Notice: Subject to any disclaimer, the term of this patent is extended or adjusted under 35 U.S.C. 154(b) by 126 days.

(21) Appl. No.: 10/241,328

(22) Filed: Sep. 11, 2002

(65) Prior Publication Data

US 2004/0045227 A1 Mar. 11, 2004

(51) Int. Cl.[7] ..... E04B 1/34; E04G 11/04; E04H 15/20

(52) U.S. Cl. ..... 52/2.15; 52/745.07; 52/80.1; 52/405.1; 52/81.1

(58) Field of Search ..... 52/745.07, 2.15, 52/80.1, 309.9, 405.1, 745.08, 81.1, 81.2, 81.3; 264/32; 135/124

(56) References Cited

U.S. PATENT DOCUMENTS

| | | | | | |
|---|---|---|---|---|---|
| 2,223,418 | A | | 12/1940 | Hewett | |
| 2,335,300 | A | | 11/1943 | Neff | |
| 2,385,296 | A | | 9/1945 | Moore | |
| 2,580,231 | A | | 12/1951 | Lamm | |
| 2,820,990 | A | | 1/1958 | Johnson | |
| 3,246,439 | A | | 4/1966 | Foster, Jr. et al. | |
| 3,277,219 | A | | 10/1966 | Turner | |
| 3,292,338 | A | | 12/1966 | MacClarence et al. | |
| 3,462,521 | A | | 8/1969 | Bini | |
| 3,668,287 | A | | 6/1972 | Mackie | |
| 3,734,670 | A | * | 5/1973 | Stickler, Jr. | 425/405.1 |
| 3,776,805 | A | * | 12/1973 | Hansen | 428/35.9 |
| 3,909,992 | A | * | 10/1975 | Stachiw | 52/2.15 |
| 3,918,233 | A | | 11/1975 | Simpson | |
| 3,924,363 | A | * | 12/1975 | Candle | 52/2.19 |
| RE28,689 | E | | 1/1976 | Turner | |
| 3,968,604 | A | | 7/1976 | Hills | |
| 3,996,320 | A | | 12/1976 | Bini | |
| 4,077,177 | A | | 3/1978 | Boothroyd et al. | |
| 4,102,956 | A | * | 7/1978 | Heifetz | 264/32 |
| 4,155,967 | A | | 5/1979 | South et al. | |
| 4,170,093 | A | | 10/1979 | Cappellini et al. | |
| 4,324,074 | A | | 4/1982 | South et al. | |
| 4,442,059 | A | | 4/1984 | Boyce | |
| 4,550,544 | A | | 11/1985 | Thoeny | |
| 4,567,696 | A | * | 2/1986 | Malet | 52/2.25 |
| 4,723,751 | A | | 2/1988 | Hale | |
| 4,788,803 | A | | 12/1988 | Seitz | |
| 5,007,212 | A | * | 4/1991 | Fritts et al. | 52/2.18 |
| 5,094,044 | A | | 3/1992 | Dykmans | |
| 5,163,360 | A | | 11/1992 | Petz | |
| 5,188,690 | A | | 2/1993 | Daussan et al. | |
| 5,479,743 | A | * | 1/1996 | Queen et al. | 52/2.22 |
| 5,487,400 | A | * | 1/1996 | Dawkins | 135/87 |
| 5,579,609 | A | | 12/1996 | Sallee | |
| 5,918,438 | A | | 7/1999 | South | |
| 5,950,512 | A | | 9/1999 | Fields | |
| 6,260,306 | B1 | * | 7/2001 | Swetish et al. | 52/2.18 |

OTHER PUBLICATIONS

Freda Parker, *Crenosphere, A Dream Come True*, Roundup Journal of the Monolithic Dome Institute, Winter 2000, pp. 24–27.

* cited by examiner

*Primary Examiner*—Carl D. Friedman
*Assistant Examiner*—Chi Q. Nguyen
(74) *Attorney, Agent, or Firm*—Workman Nydegger

(57) ABSTRACT

A building includes an inflatable form having an interior surface bounding a chamber. A stabilizing layer of polymeric foam or cementitious material is disposed on the interior surface of the inflatable form. At least one support layer of cementitious material is disposed on the interior surface of the stabilizing layer. Finally, one or more ribs project from the interior surface of the at least one support layer. Each rib includes a core of polymeric foam and a layer of cementitious material disposed over the core.

37 Claims, 21 Drawing Sheets

BUILDING WITH FOAM CORED RIBS AND METHOD

CROSS-REFERENCE TO RELATED APPLICATIONS

Not applicable.

BACKGROUND OF THE INVENTION

1. The Field of the Invention

The present invention relates to buildings and, more specifically, enlarged domed buildings having reinforcing ribs formed on the inside thereof.

2. The Relevant Technology

The use of freestanding dome shaped buildings is becoming increasingly popular. In contrast to conventional rectangular buildings, dome shaped buildings can be formed relatively quickly and have a large interior space which is free from obstructions such as columns or other supports. Conventional dome structures are formed by inflating a flexible liner. One or more reinforced layers of shotcrete are formed on the interior surface of the liner. Once the shotcrete is cured, the dome is self-supporting.

One of the historical shortcomings in the formation of dome structures is the inability to continue to construct larger sized domes using conventional methods. That is, prior to setting of the shotcrete, the dome structure are largely supported by an applied internal air pressure. As the dome increases in size, however, the thickness of the shotcrete layer must also increase to provide the required, structural strength. As the amount of shotcrete increases, however, the weight on the dome also increases until the weight of the shotcrete is greater than the applied air pressure to support it. This can result in catastrophic failure of the dome structure during assembly.

Attempts to further increase the supporting air pressure within the dome have simply resulted in failure of the liner, such as by rupture. Attempts have also been made to increase the structural strength of such domes by forming solid concrete ribs on the interior surface of the dome. Such solid concrete ribs, however, are difficult to form and add significant additional weight to the dome.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

I. Introduction

Figure 1:
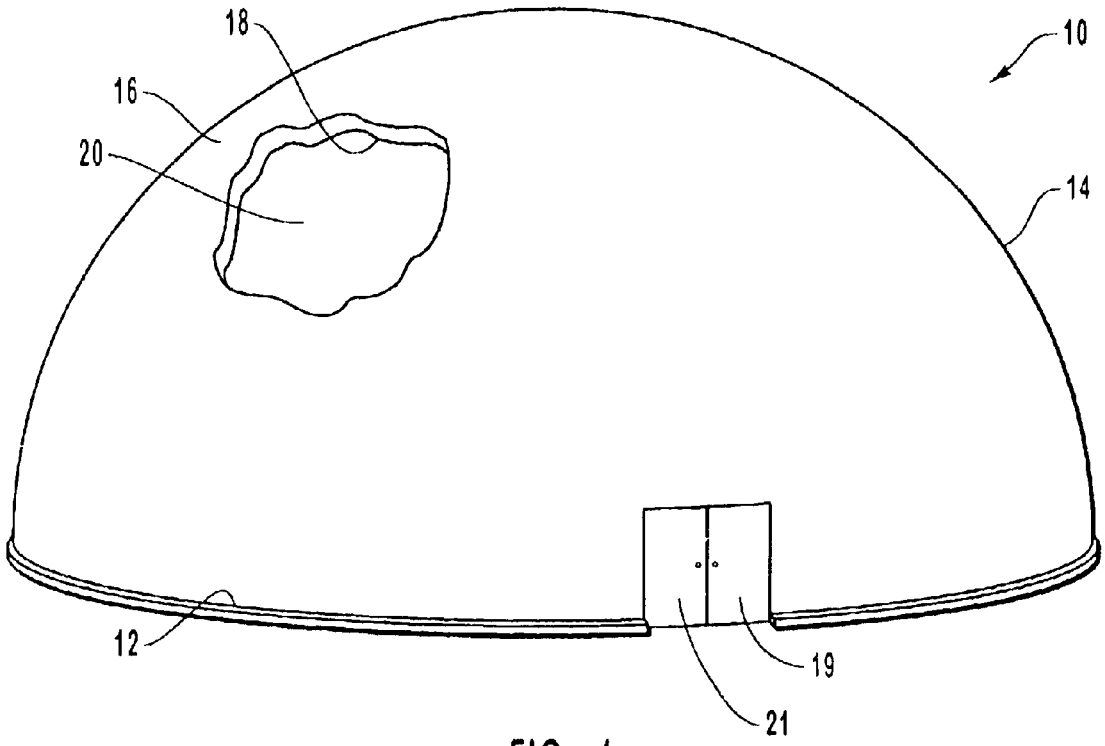
FIG. 1 is a perspective view of a domed building.

Depicted in FIG. 1 is one embodiment of an inventive building 10 incorporating features of the present invention. In general, building 10 comprises an annular footing 12 on which a dome shaped boundary wall 14 is formed. Boundary wall 14 has an exterior surface 16 and an interior surface 18. Interior surface 18 bounds a chamber 20. Chamber 20 is accessible through an entrance 19 which extends through boundary wall 14 and is selectively blocked by doors 21. If desired, a shelter can be formed on the exterior of building 10 so as to cover entrance 19.

Figure 2:
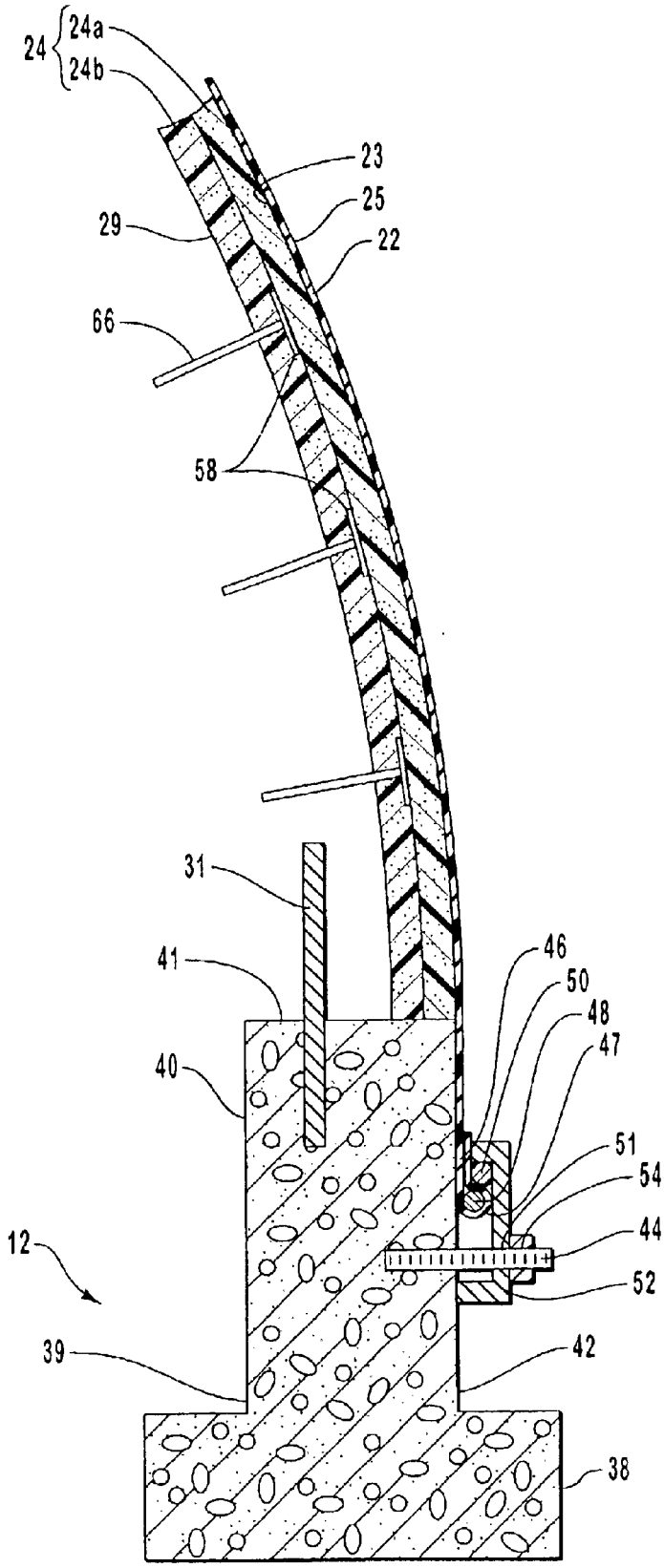
FIG. 2 is a cross section side view of a portion of the building shown in FIG. 1 in a partially assembled state.

Briefly stated, in one embodiment building 10 is constructed by first laying footing 12. With reference to FIG. 2, an inflatable form 22 is then secured to the exterior surface of footing 12 in air-tight relation therewith. Form 22 is then inflated to a first air pressure. Once form 22 is inflated, one or more stabilizing layers is applied against an interior surface of form 22. An example of a suitable material for the stabilizing layer is a polymeric foam which can be sprayed onto form 22.

In one embodiment of the present invention, means are provided for reinforcing form 22 so that form 22 can withstand higher internal air pressures without failure. One example of the means for reinforcing form 22 comprises one or more layers of reinforcing line embedded laterally, longitudinally, and/or otherwise within the stabilizing layer.

Alternatively or in combinations therewith, the means for reinforcing form 22 comprises a plurality of interconnected retention lines secured over the exterior surface of form 22.

Mounted on the interior surface of the one or more stabilizing layers is a reinforcing mat which typically comprises interconnecting strands of rebar. One or more support layers are then applied over the interior surface of the stabilizing layer such that the reinforcing mat is embedded therein. In one embodiment, the one or more support layers is typically formed of a cementitious material such as concrete or shotcrete.

Although not required, in one embodiment an array of ribs is formed on the interior surface of the support layer. As discussed below in greater detail, the ribs can have a variety of different configurations and can be positioned in a variety of different orientations. Finally, if desired, a finish layer can be applied over the support layer and ribs.

Depending on the size and configuration of building 10, the amount of internal air pressure within chamber 20 can be selectively increased at various stages during development. In part, the increased air pressure supports the building as the various layers are applied and harden to obtain their final strength.

The inventive building process enables the safe manufacture of dome shaped buildings on a significantly larger scale than what was enabled under the prior art. Outlined below is a detailed description of examples of alternative methods for manufacturing buildings incorporating domed features. Although the methods are primarily discussed with reference to the manufacture of the annular domed shaped building 10 shown in FIG. 1, it is appreciated that substantially the same methods can be used in the manufacture of other shaped buildings which incorporate dome features. Examples of the shapes of such other buildings will also be discussed below. Furthermore, it is also appreciated that substantially the same methods can be used in the manufacture of building which do not incorporate a dome feature.

II. Footing

Footing 12 provides a foundation for building 10 and defines the outer perimeter thereof. As depicted in FIG. 2, footing 12 comprises an outwardly extending base portion 38 and a wall portion 40 upwardly extending therefrom. Wall portion 40 has an interior surface 39, a top surface 41, and an exterior surface 42. A plurality of spaced apart bolts 44 are partially embedded within wall portion 40 so as to radially outwardly project from exterior surface 42 thereof. In one embodiment, bolts 44 are disposed about every 25 cm to about every 100 cm around footing 12. Other spacing can also be used based on building parameters. As will be discussed below in greater detail, bolts 44 are used to secure inflatable form 22 to footing 12.

Also partially embedded within footing 12 so as to upwardly project from top surface 41 of wall portion 40 are a plurality of spaced apart reinforcing rods 31. As will be discussed below in greater detail, reinforcing rods 31 are used to facilitate a rigid connection between footing 12 and boundary wall 14. Reinforcing rods 31 typically comprise conventional steel rebar although other conventional reinforcing materials can also be used. Reinforcing rods 31 are typically placed about every 25 cm to 100 cm, although other spacing can also be used based on building parameters.

Footing 12 is typically comprised of poured concrete having reinforcing embedded therein. In the embodiment shown, footing 12 has a inverted substantially T-shaped transverse cross section. In alternative embodiments, footing 12 can have any desired transverse cross section that satisfies the building parameters. For example, footing 12 should be dimensioned to withstand frost conditions and be designed in accordance with the size of the building and the weight bearing capacity of the underlying soil.

As previously mentioned, footing 12 outlines the perimeter or footprint for building 10. In one embodiment, footing 12 is placed in a circular path. In alternative embodiments, as will be discussed below with regard to final building designs, footing 12 can also be placed in a variety of other patterns such as oval, polygonal, irregular, or combinations thereof.

In one embodiment, wall portion 40 of footing 12 may be placed completely under ground or project a few feet above the ground surface. In alternative embodiments, wall portion 40 can vertically extend so as to form a wall around the base of building 10. For example, wall portion 40 can have a height in a range between about 2 meters to about 8 meters or any other desired height. In this embodiment, entrance 19 to building 10 can be formed through wall portion 40.

It is generally desirable that prior to securing inflatable form 22 to foundation 12, all equipment that will be used in the construction of building 10 and which is too large to be moved into the building area through an access, to be described below, be placed within the area of chamber 20 bounded by footing 12. Once the equipment is positioned, form 22 is spread over the equipment and secured to footing 12.

III. Inflatable Form

Figure 3:
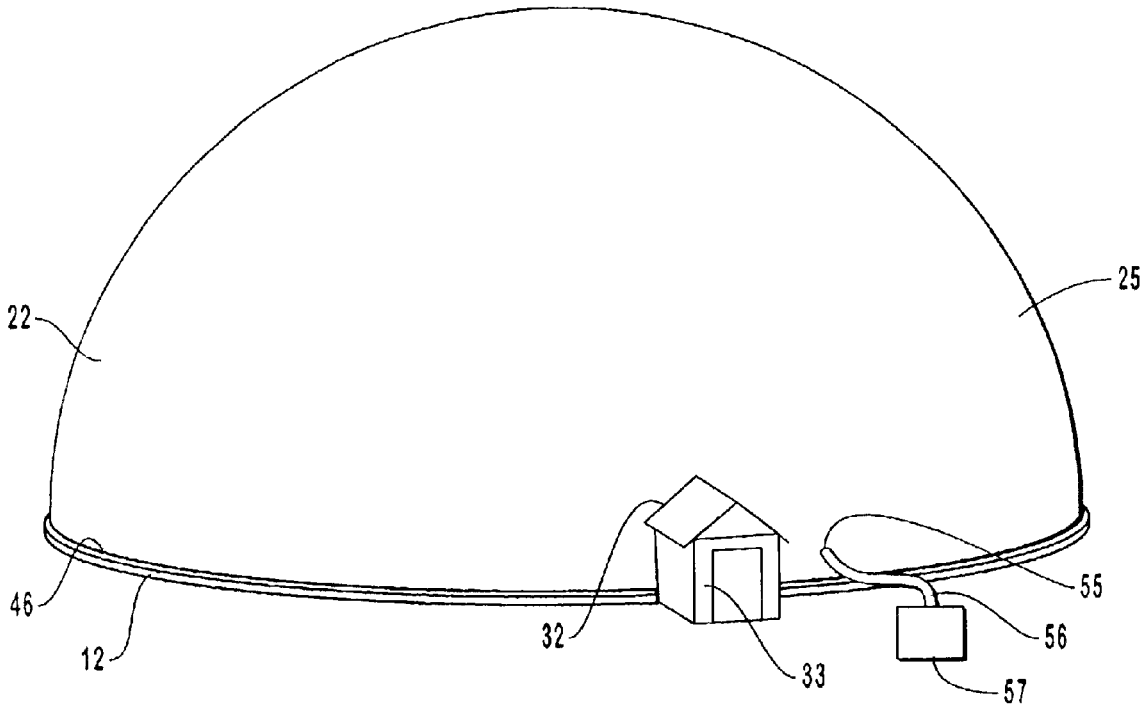
FIG. 3 is a perspective view of an inflated form mounted on a footing.

As depicted in FIGS. 2 and 3, inflatable form 22 comprises a plurality of flexible, sheet-like panels that have been sewn, seamed, or otherwise secured together such that when mounted on footing 12 and inflated, form 22 forms a substantially dome-shaped surface. Alternatively, inflatable form 22 can be configured so that at least a portion of the form forms a dome shaped configuration or so that the form does not include a dome shaped configuration. For example, inflatable form 22 can form a box, cone, or other configuration.

Form 22 has an interior surface 23 and an exterior surface 25 which each extend to an outer peripheral edge 46. In one embodiment, form 22 is comprised of a lightweight gas and liquid impermeable flexible sheet. The sheet can be formed from a cross laminate plastic, a reinforced plastic coated fabric, such as a polyvinyl chloride impregnated Dacron, or any other suitable material. Furthermore, form 22 can be formed of one or more layers of material. As will become more apparent hereinbelow, form 22 may be reusable or may be left in place after forming building structure 10.

In one embodiment of the present invention, means are provided for securing form 22 to footing 12 in a substantially air tight engagement. By way of example and not by limitation, a loop 47 is formed at peripheral edge 46 of form 22. A line 48, such as a cord or cable, is passes through loop 47 so as to extend along peripheral edge 46. In alternative embodiments, line 48 can be secured to peripheral edge 46 by use of any of a number of conventional techniques. Peripheral edge 46 having line 48 coupled therewith is positioned against exterior surface 42 of footing 12 so that form 22 covers the area bounded by footing 12.

A sheathed clamping cable 50 is then positioned against exterior surface 25 of form 22 above line 48. Clamping cable 50 is tensioned in a continuous loop so as to bias form 22 against exterior surface 42 of footing 12, thereby preventing line 48 from passing between clamping cable 50 and footing 12. In one embodiment, clamping cable 50 is disposed tightly against line 48.

Once clamping cable 50 is tensioned, a plurality of elongated clamps 52 are mounted to footing 12. Each clamp 52 has a substantially C-shaped transverse cross section with spaced apart apertures 51 formed along the length thereof. Clamps 52 are mounted against footing 12 so as to cover line 48 and clamping cable 50 with bolts 44 extending through apertures 51. A nut 54 is threaded onto the free end of each bolt 44 so as to securely bias each clamp 52 against footing 12. Clamps 52 thus prevent clamping cable 50 and/or line 48 from sliding off of footing 12 during the inflation of form 22.

One alternative embodiment of the means for securing form 22 to footing 12 is depicted in FIG. 2 of U.S. Pat. No. 4,324,074. Disclosure within the '074 patent relating to securing the form to the footing is hereby incorporated by specific reference. It will be appreciated that other embodiments also exist for securing form 22 to footing 12. By way of example and not by limitation, bolts, hooks, and other types of fasteners can be used to directly secure form 22 to footing 12.

As depicted in FIG. 3, an air port 55 is formed on form 22. A duct 56 provides sealed communication between air port 55 and a blower 57. During operation, blower 57 is activated causing air from the surrounding environment to be blown through duct 56 and air port 55 so as to inflate form 22. As a result of the inflation of form 22, chamber 20 is bounded therein.

Blower 57 is used to inflate form 22 so that a first air pressure is formed therein. In one embodiment, the first pressure is in a range between about ½ inch $H_2O$ to about 2 inches $H_2O$ of static pressure. In other embodiments depending on the weight and size of form 22, other pressures may also be used.

To enable access to chamber 20, a temporary access 32 is formed on form 22 adjacent to air port 55. Mounted in substantially sealed communication with temporary access 32 is an air lock 33. In one embodiment, air lock 33 simply comprises a structure having a first doorway, a second doorway, and a compartment formed therebetween. As people enter and exit chamber 20 through air lock 33, only one of the first and second doorways is open at a time. As a result, air within chamber 20 cannot significantly escape through air lock 33. The pressure within chamber 20 is thus maintained within a desired safety range.

As previously discussed, where wall portion 40 of footing 12 upwardly extends to form a perimeter wall, it is also appreciated that temporary access 32 and/or air port 55 can be formed through wall portion 40 as opposed to through form 22. When building structure 10 is completed, air port 55 and/or temporary access 32 may eventually form entrance 19 or a window.

After form 22 is inflated, entrances, windows, and all other openings that are to be present on building 10 are marked on interior surface 23 of inflated form 22. In one embodiment, the various layers of rebar and/or other select layers can be applied so as not to cover the marked openings. As a result, the openings can be more easily cut out once construction of building 10 is completed.

IV. Stabilizing Layer

Returning to FIG. 2, after inflating form 22 a stabilizing layer 24 is applied to interior surface 23 of form 22. Stabilizing layer 24 is generally comprised of a polymeric foam. As used in the specification and appended claims, the term "polymeric foam" is intended to include all polymeric materials that have been expanded in some way so as to form a foam. Examples of polymeric foams include polyurethane foam, Styrofoam, and other conventional expandable polymeric foams. The polymeric foam can also comprise additives such as fillers, fibers, or other additives which affect properties such as strength, expansion, setting, finish, and the like. The polymeric foam can be applied through conventional spraying techniques or other conventional processes. Likewise, the polymeric foam can be applied in prefabricated configurations. One common example of a polymeric foam used in the manufacture of stabilizing layer 24 is 1½ lb/ft$^3$ to 2 lb/ft$^3$ polyurethane foam which is sprayed onto form 22. In other embodiments, it is also appreciated that non-polymeric materials, such as cementitious materials, adhesives, or any other types of materials that can be applied and then set to provide structural support, can also be used for stabilizing layer 24.

Although not required, in one embodiment to help ensure that stabilizing layer 24 initially secures to interior surface 23 of form 22 as stabilizing layer 24 is initially applied thereto, a bonding agent is applied in a layer over interior surface 23 of form 22. In one embodiment, the bonding agent comprises an acrylic latex bonding agent such as V-COAT available from Diamond Vogel Paint out of Orange City, Iowa. In other embodiments, the bonding agent can simply comprise as rewettable bonding agent that has adhesive properties when hydrated so as to help stick stabilizing layer 24to form 22. Use of the bonding agent is most applicable when stabilizing layer 24 is comprised of a cementitious material.

In part, stabilizing layer 24 functions to initially stabilize form 22 and provided a basis on which additional layers can be built. Although not required, the material for stabilizing layer 24 can be selected so as to have insulative properties. In this embodiment, stabilizing layer 24 forms an insulation barrier which helps control the temperature within chamber 20 and prevent the formation of condensation on the interior surface of building 10 bounding chamber 20. The material for stabilizing layer 24 can also be selected so that form 22 can be removed after or during the development of building 10. Alternatively, the material can be selected so that stabilizing layer 24 permanently adheres to form 22.

Depending on the engineering design of building 10, stabilizing layer 24 can be formed as a single layer from a single application. Alternatively, stabilizing layer 24 can be comprised of multiple overlapping sub-layers of the same or different materials. For example, stabilizing layer 24 comprises a first stabilizing sub-layer 24*a* and a second stabilizing sub-layer 24*b*. First stabilizing sub-layer 24*a* and second stabilizing sub-layer 24*b* combine to form a single, substantially inseparable stabilizing layer 24. In yet other embodiment, it is appreciated that stabilizing layer 24 may not be required at all.

Stabilizing layer 24 is applied to inner surface 23 of inflated form 22 by initially spraying first stabilizing sub-layer 24*a* having a thickness in a range between about 1 cm to about 5 cm with about 1 cm to about 3 cm being more common. A plurality of spaced apart hanger 58 are then mounted on sub-layer 24*a*.

Figure 4:
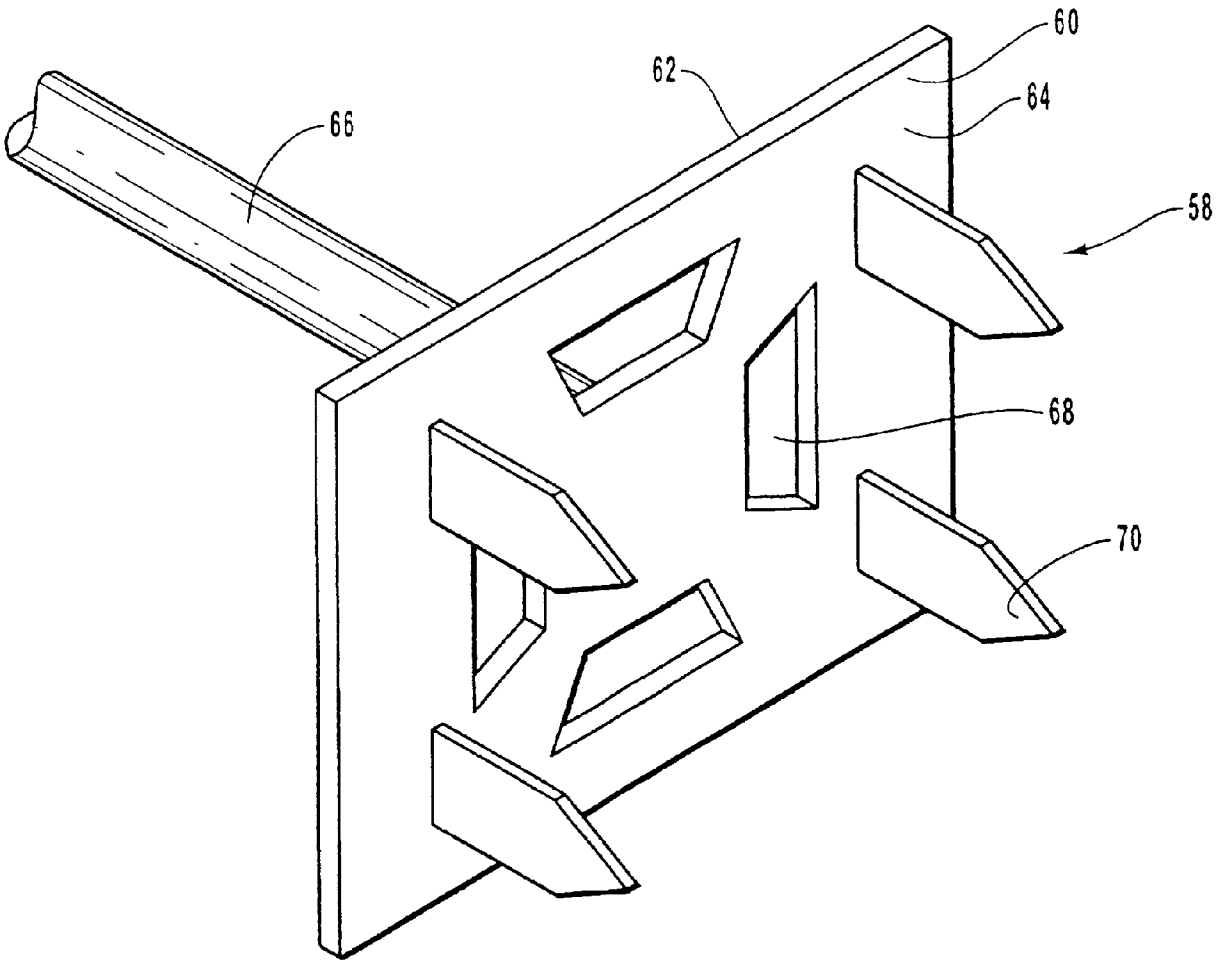
FIG. 4 is a perspective view of a hanger.

As depicted in FIG. 4, each hanger 58 comprises a planar base plate 60 having a front side 62 and an opposing back side 64. An elongated hanger rod 66 centrally projects from front side 62. Each side of base plate 60 typically has a surface area in a range between about 1 square inch to about 4 square inches with about 2 square inches being more common. Base plate 60 is generally made of a suitable strength metallic sheet such as galvanized sheet steel. A plurality of holes 68 may be formed through base plate 60 so as to reduce the overall weight of each hanger 58 and allow communication therethrough. In an alternative embodiment, base plate 60 can be formed of other materials such as plastic, composites, or other types of metals.

In one embodiment of the present invention, means are provided for securing hangers 58 to stabilizing sub-layer

24*a*. By way of example and not by limitation, outwardly projecting from back side 64 of base plate 60 are a plurality of spaced apart barbs 70. Barbs 70 are configured such that hangers 58 can initially be secured to stabilizing sub-layer 24*a* by simply pushing barbs 70 into stabilizing sub-layer 24*a* until base plate 60 rests against stabilizing sub-layer 24*a*.

In alternative embodiments of the means for securing hangers 58, barbs 70 can be formed with outwardly engaging teeth. In other embodiments, barbs 70 can have a spiral configuration or be replaced with hooks, spikes, adhesive pads, adhesive, and other conventional fasteners. Furthermore, it is appreciated that hangers 58 can be replaced with other hangers or ties used in conventional building practices.

Each hanger rod 66 is generally made of a flexible metal, such as aluminum, and is secured in a generally normal relationship to the plane of the associated base plate 60. Hangers 58 are secured to first stabilizing sub-layer 24*a* such that hanger rods 66 project inwardly from first stabilizing sub-layer 24*a* in substantially normal relation thereto.

Referring again to FIG. 2, once hangers 58 are secured to first stabilizing sub-layer 24*a*, a second stabilizing sub-layer 24*b* is sprayed over stabilizing sub-layer 24*a* so as to embed base plate 60 of hangers 58 therebetween. The now complete stabilizing layer 24 typically has a thickness in a range between about 5 cm to about 15 cm. The thickness of stabilizing layer 24 in part depends on the desired amount of insulation. In general, insulative properties increase as stabilizing layer 24 gets thicker. It will be appreciated that first stabilizing sub-layer 24*a* and second stabilizing sub-layer 24*b* may have the same thickness or have different thicknesses. In one example, first stabilizing sub-layer 24*a* is about 5 cm thick and second stabilizing sub-layer 24*b* is about 5 cm thick. In another example, first stabilizing sub-layer 24*a* is about 5 cm thick and second stabilizing sub-layer 24*b* is about 8 cm thick. Additionally, it will be appreciated that first stabilizing sub-layer 24*a* and second stabilizing sub-layer 24*b* may be comprised of the same material or different material. Other combinations may also be employed depending on the engineering design and construction needs of building structure 10.

Each hanger rod 66 of hangers 58 has a predetermined length. As such, during the application of second stabilizing sub-layer 24*b*, the operator is able to visually observe the depth of stabilizing sub-layer 24*b* being applied through observing the build-up depth along the length of hanger rods 66. Additionally, the relatively thin hanger rods 66 enable a uniform spraying of polymeric foam about hanger rods 66 without impairing uniformity of density or layer thickness of the foam. Hanger rods 66 are made long enough to extend outwardly from the completed stabilizing layer 24 a distance in a range between about 8 cm to about 15 cm, although other dimensions can also be used. It is also appreciated that markings can be formed along the length of hanger rods 66 so as to assist in forming stabilizing sub-layer 24*b* to a desired depth.

As a result of base plate 60 of hangers 58 being at least partially embedded within stabilizing layer 24, a reinforcing mat, as discussed below, can now be secured to hangers 58 without pulling hanger 58 off of stabilizing layer 24. It is also appreciated that in other embodiments base plate 60 of hangers 58 can be sufficiently secured directly to an interior surface 29 of stabilizing layer 24 so that base plate 60 need not be embedded within stabilizing layer 24.

V. Reinforcing Inflatable Form

As stabilizing layer 24 and/or other layers, as discussed below, are formed inward of inflated form 22, the weight of building 10 increases. In some embodiments, depending on the size and configuration of building 10, it is desirable to incrementally increase the air pressure within chamber 20 produced by blower 57 so as to support the increased weight load of the building while the various layers are applied and/or set to reach their supporting strength.

The air pressure, however, cannot be increased beyond the pressure limits of form 22 or, where applicable, the combination of form 22 and stabilizing layer 24. Accordingly, to enable the air pressure within chamber 20 to be safely increased, means are provided for reinforcing form 22 and/or support layer 24. By way of example and not by limitation, in one embodiment the means for reinforcing comprises reinforcing line embedded within stabilizing layer 24. In an alternative embodiment, the means for reinforcing comprises a retention assembly secured over form 22. The reinforcing line and retention assembly are configured to absorb at least a portion of the increased pressure load applied to form 22 and/or stabilizing layer 24.

A. Reinforcing Line

Figure 5:
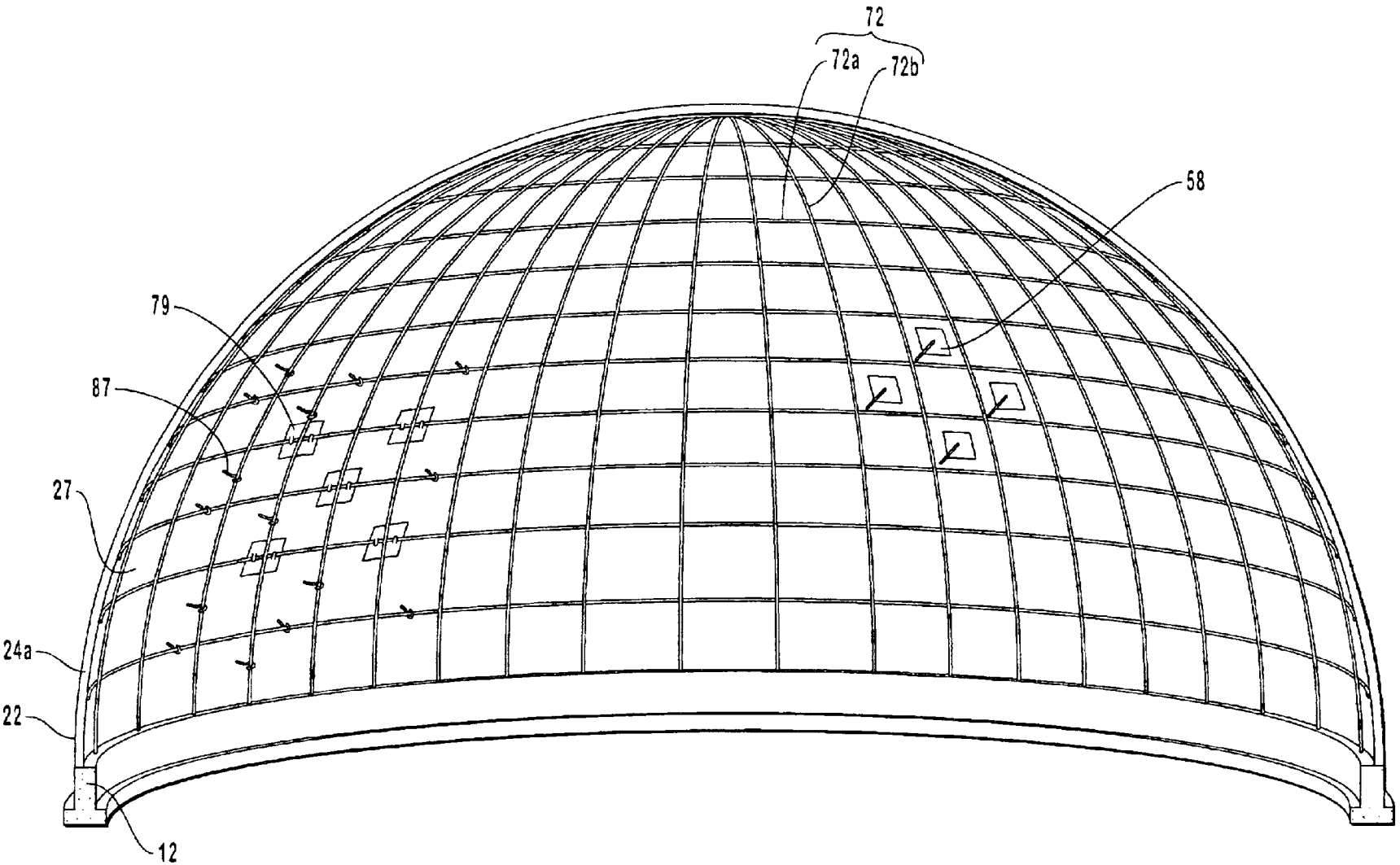
FIG. 5 is a cross sectional side view of a partially assembled building having reinforcing line mounted against a stabilizing layer.

Depicted in FIG. 5, reinforcing line 72 is mounted on an interior surface 27 of first stabilizing sub-layer 24*a*. Reinforcing line 72 can be mounted prior to, simultaneously with, or following the securing of hangers 58 to first stabilizing sub-layer 24*a*. In one embodiment, reinforcing line 72 typically comprises wire, cable, cord, plastic line, rope, webbing, or other types of flexible line having sufficient tensile strength to withstand the force produced by the air pressure within chamber 20. In one embodiment, reinforcing line has a tensile strength in a range between about 20,000 psi to about 200,000 psi.

Reinforcing line 72 can comprise one or more strands and can be positioned in any desired orientation, such as horizontal, vertical, spiral, sloped, and combinations thereof, at any desired spacing. For example, depicted in FIG. 5, reinforcing line 72 comprises a continuous strand 72*a* spirally secured around interior surface 27 of first stabilizing sub-layer 24*a* so as to extend from footing 12 up to the top of domed building 10. Strand 72*a* can be replaced with discrete horizontally disposed loops.

Furthermore, in place of or in conjunction with spirally wound strand 72*a*, reinforcing line 72 comprises strands 72*b* which are vertically disposed between footing 12 and the top of building structure 10. For example, strand 72*b* comprises either discrete strands or a continuous strand of reinforcing line 72 that extends from footing 12 on one side of building structure 10, over the central top of building structure 10, and then back to footing 12 on the opposing side thereof. Conventional concrete anchors can be used to secure reinforcing line 72 to footing 12.

Figure 6:
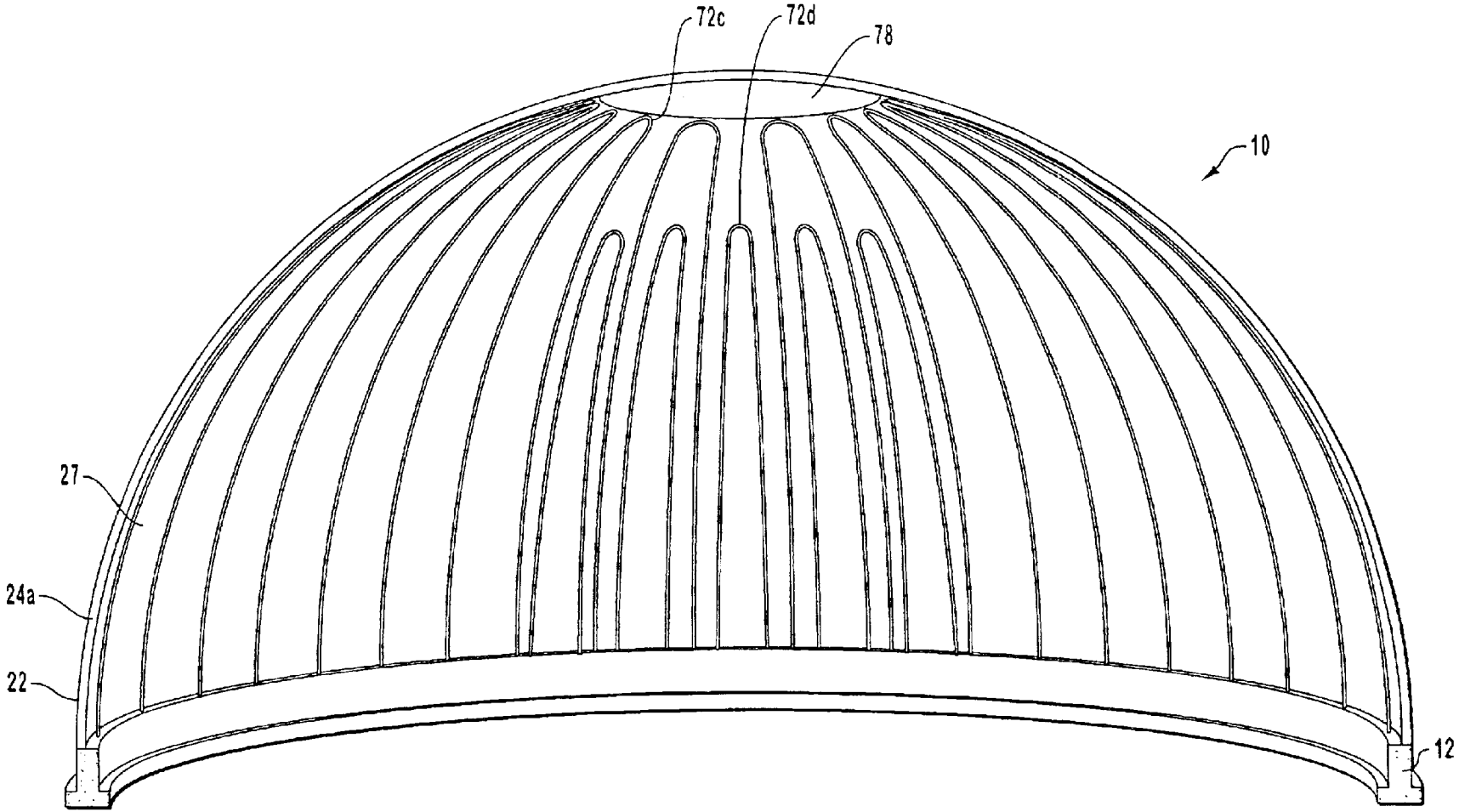
FIG. 6 is a cross sectional side view of a partially assembled building showing an alternative placement of reinforcing line.

In one embodiment as shown in FIG. 6, it is desirable to form an enlarged opening 78 through the top of building 10 once building 10 is completed. Opening 78 can be used to feed material into chamber 20 or receive an plenum tube. Where opening 78 is to be formed on building 10, staggered loops 72*c* of either discrete or continuous strands of reinforcing line 72 can extend up from footing 12 to a location adjacent to opening 78 and then loop back to a spaced apart location on footing 12.

Since the surface area of the top portion of building 10 is smaller than the surface area of the base portion thereof, continuous or discrete strands 72*d* of reinforcing line 72 need only extend a portion of the vertical distance to the location of opening 78. It will be appreciated that reinforcing line 72 can be overlaid and crisscrossed so as to be configured in any desired pattern. The spacing between adjacent loops or strands of reinforcing line 72 depends on the size and configuration of building 10. In one embodiment, the spacing is in a range between about 15 cm to about 50 cm on-center, although other spacing can also be used. Although not required, in one embodiment reinforcing line 72 or sections thereof can be tensioned at the time of placement in a range between about 15 cm to about 125 cm.

Figure 7:
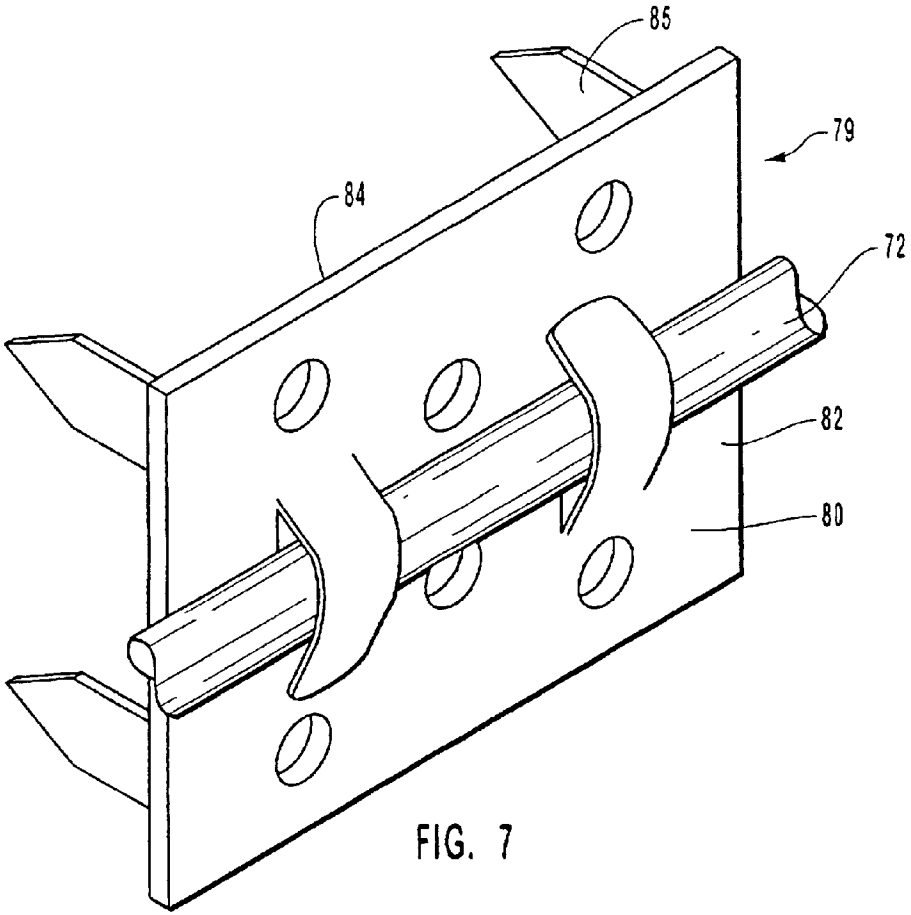
FIG. 7 is a perspective view of one embodiment of a line hanger.

Reinforcing line 72 can initially be secured to stabilizing sub-layer 24*a* by simply being disposed beneath base plate 60 of hangers 58. Alternatively, specifically designed line hangers can be used. For example, as depicted in FIGS. 5 and 7, is a first embodiment of a line hanger 79. Line hanger 79 comprises a plate 80 having a front side 82 and a back side 84. Projecting from back side 84 of plate 80 are a plurality of spaced apart barbs 85. Barbs 85 are configured to be pushed into stabilizing sub-layer 24*a* so as to secure plate 80 thereto. In alternative embodiments, barbs 85 can be replaced with the alternatives as previously discussed with regard to barbs 70 on hangers 58.

In one embodiment of the present invention, means are provided for securing line 72 to front side 82 of plate 81. By way of example and not by limitation, projecting from front side 82 of plate 81 two spaced apart securing arms 86. Arms 86 face in opposing directions so that line 72 can be captured therebetween. In one embodiment, arms 86 can be flexible to selectively fold over line 72 while in other embodiments, arms 86 are rigid so that line 72 must be feed below arms 86. In other embodiments, arms 86 can be replaced with a clamp, clip, or any other type of conventional fastener for securing line 72 to plate 81. Plate 80 is formed of a relatively thin metal such that securing arms 86 can be stamped out by well-known machining processes. It will be appreciated that hangers 58 may be configured to provide the function of both hanger 58 and line hanger 79 by adding arms 86 to plate 60 of hanger 58.

Figure 8:
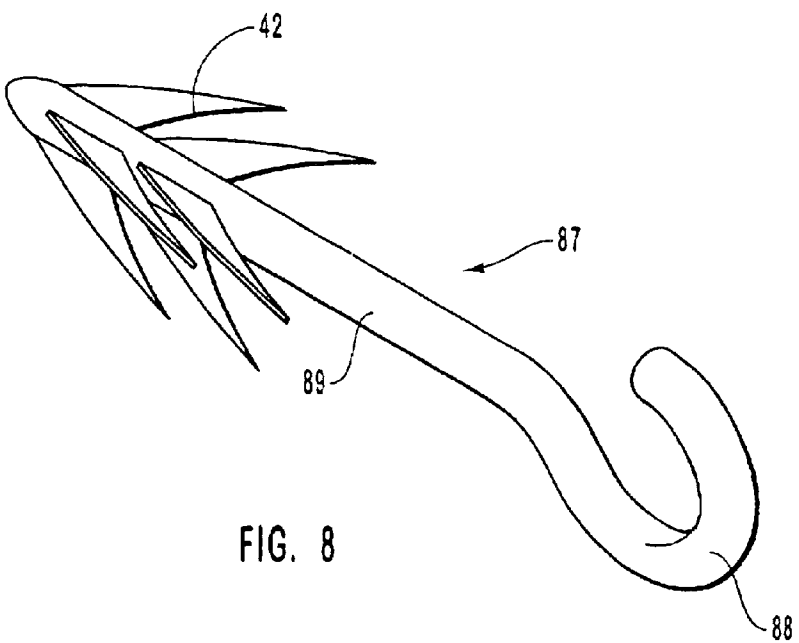
FIG. 8 is a perspective view of an alternative embodiment of a line hanger.

Depicted in FIGS. 5 and 8 is an alternative embodiment of a line hanger 87. Line hanger 87 comprises a shaft 89. A hook 88 is located at one end of shaft 89 and is configured to receive and hold reinforcing line 72. In alternative embodiments, hook 88 can be replaced with a clip, clamp, or other conventional types of fasteners. Located at the opposing end of shaft 89 are a plurality of outwardly projecting barbs 92. By securing reinforcing line 72 within hook 88 and pushing barbs 92 into stabilizing sub-layer 24*a*, reinforcing line 72 is secured to stabilizing sub-layer 24*a*.

Figure 9:
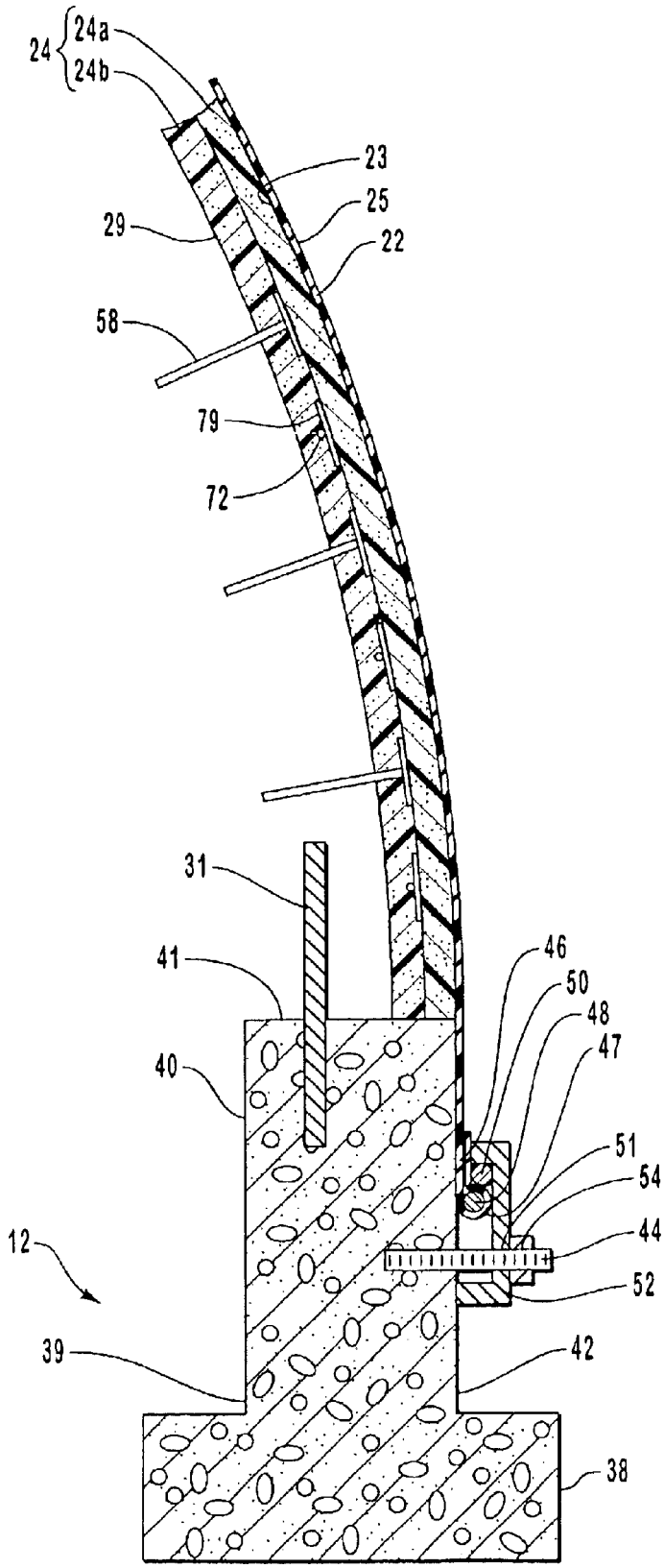
FIG. 9 is a cross sectional side view of a partially assembled building showing hangers and retention line embedded within a stabilizing layer.

As depicted in FIG. 9, once reinforcing line 72 is secured to stabilizing sub-layer 24*a*, stabilizing sub-layer 24*b* is applied over sub-layer 24*a*, reinforcing line 72 and the various line hangers, thereby securely embedding reinforcing line 72 within stabilizing layer 24. In this configuration, as the air pressure within chamber 20 is increased, the force produced by the air pressure is at least partially carried by reinforcing line 72. As a result, the air pressure within chamber 20 can be increased to support the load produced by added layers with minimal risk of failure of form 22.

In an alternative it is appreciated that reinforcing line 72 need not be embedded within stabilizing layer 24 but can merely be secured to interior surface 29 of stabilizing layer 24. In other embodiments, stabilizing layer 24 can comprises three or more sub-layers with different elements being disposed at different sub-layers. For example, in one embodiment hangers 58 are secured to first stabilizing sub-layer 24*a* of stabilizing layer 24 as previously discussed. Second stabilizing sub-layer 24*b* is then applied over hangers 58 to secure hangers 58 in place. Reinforcing line 72 is then secured to second stabilizing sub-layer 24*b* by the use of line hangers as discussed above. Finally, a third stabilizing sub-layer 24*c* (not shown) is applied over reinforcing line 72 so as to complete the formation of stabilizing layer 24.

B. Retention Assembly

Figure 10:
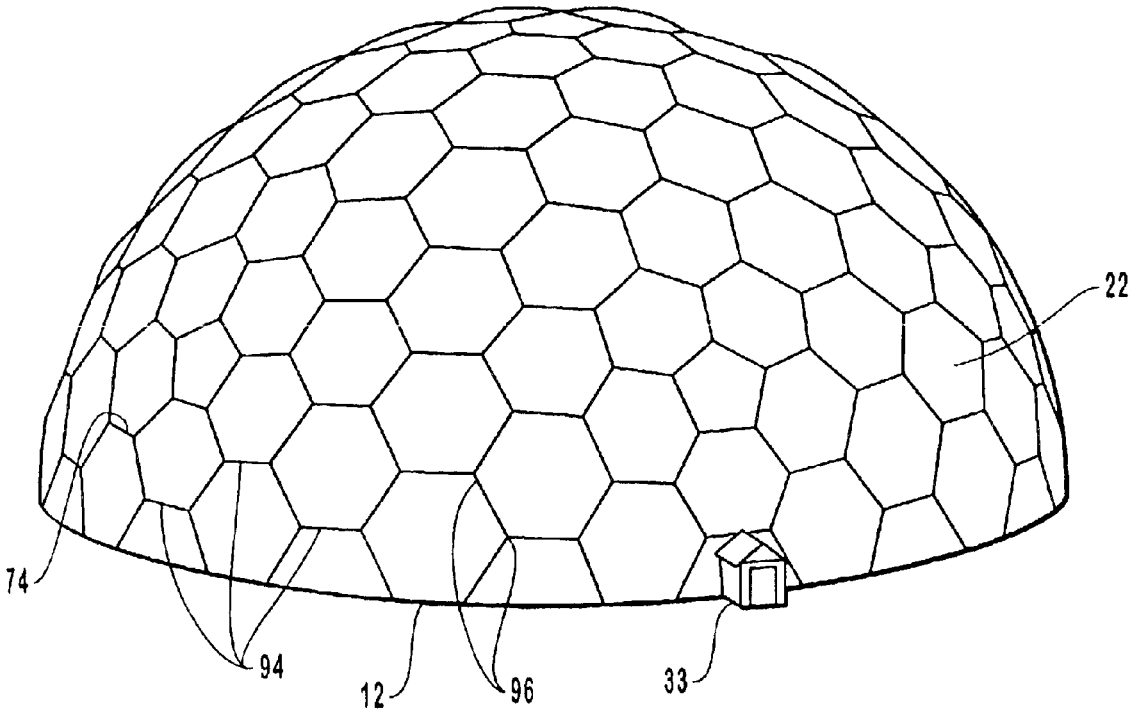
FIG. 10 is a perspective view of a building showing a retention assembly mounted on the exterior surface thereof.

Depicted in FIG. 10, a retention assembly 74 is positioned over form 22. Retention assembly 74 can be used either in conjunction with or instead of reinforcing line 72. Retention assembly 74 comprises a network of retention lines 94 that are interconnected at joints 96. Retention lines 94 can be comprised of rope, webbing, plastic line, leather straps, wire, various forms of cable, and other types of flexible line having sufficient tensile strength to withstand the tensile forces necessary to restrain pressurized inflation of form 22. That is, retention assembly 74 is configured such that pressure within chamber 20 is increased, at least a portion of the force produced by the pressure is carried by retention assembly 74. As a result, the pressure within chamber 20 can be increased without failure of form 22.

In one embodiment, retention lines 94 each have substantially the same length and are formed into a polygonal pattern, such as a plurality of hexagonal and pentagonal shaped polygons of equal length sides. Each side of each polygon is common to an immediately adjacent polygon except for the bottom most polygons adjacent to foundation 12.

In alternative embodiments, retention lines 94 can be disposed in any pattern that will achieve the objective of restraining inflated form 22. Various patterns for retention assembly 74 and techniques for connecting the ends of the retention lines 94 are described in detail in U.S. Pat. No. 5,918,438. The specific disclosure within U.S. Pat. No. 5,918,438 regarding alternative embodiments and methods for use and assembly of the retention assembly is hereby incorporated by reference.

VI. Reinforcing Mat

Figure 11:
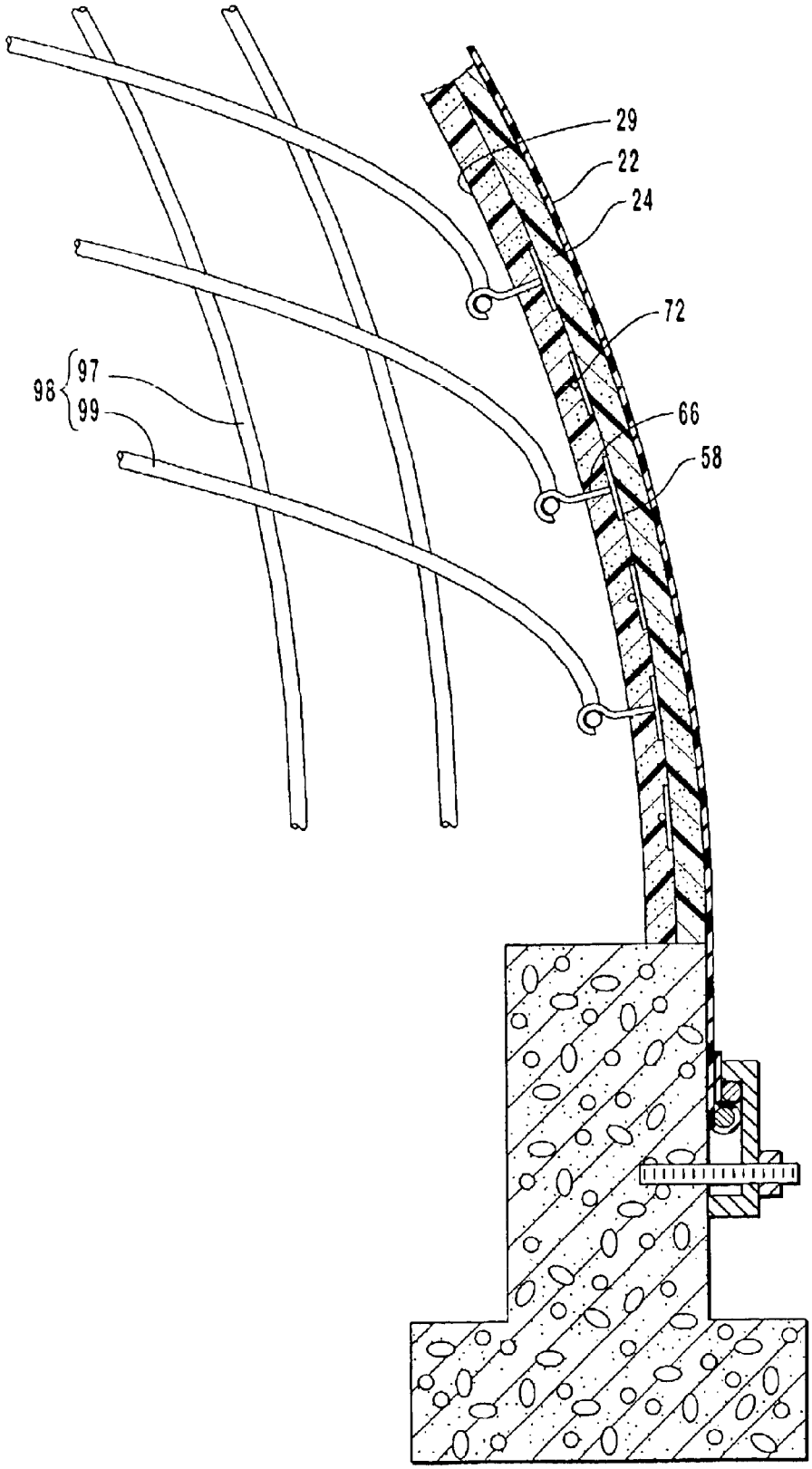
FIG. 11 is a cross sectional side view of partially assembled building showing a reinforcing mat mounted on the interior surface of a stabilizing layer.

As depicted in FIG. 11, once stabilizing layer 24 is complete, a reinforcing mat 98 is secured adjacent to interior surface 29 of stabilizing layer 24. Reinforcing mat 98 typically comprises interconnected strands of conventional rebar. In the embodiment depicted, reinforcing mat 98 comprises horizontally spaced apart vertical strands 97 that extend from footing 12 to the top of building 10 and vertically spaced apart horizontal strands 99 that encircle building structure 10. The various strands 97 and 99 are interconnected using conventional tying methods.

Reinforcing mat 98 is secured adjacent to stabilizing layer 24 using hangers 58. That is, hanger rods 66 projecting out of stabilizing layer 24 are bent around or otherwise used to secure reinforcing mat 98 in place. Although mat 98 can be positioned directly adjacent to stabilizing layer 24, in one embodiment hangers 58 are used to support reinforcing mate 98 at a spaced apart distance from stabilizing layer 24. As a result, as will be discussed below in greater detail, reinforcing mat 98 is embedded within the support layer that is applied thereon.

It is appreciated that depending on the size, configuration, and other engineering requirements of building 10, rebar of one or more different sizes can be used at different locations on building 10. Furthermore, the rebar can be positioned at one or more different spaces at different locations on building 10. For example, since the base of the building 10 carries more weight, the rebar is typically larger and/or closer together at the base of building 10 then at the top thereof. In yet other embodiments, it is appreciated that reinforcing mat 98 need not be made of conventional rebar but can be made from other reinforcing materials such as metal cable, wire, mesh, and the like.

If desired, simultaneously with securing reinforcing mat 98 to hangers 58 which are secured to stabilizing layer 24, additional hangers 58 can be secured directly to reinforcing mat 98. These additional hangers 58 are used for later suspension or mounting of an additional reinforcing mat 98. In addition, preconstructed frames, trusses, and other supports can be placed at the previously marked door and window openings on form 22 so as to provide reinforcing around these openings.

VII. Support Layer

Figure 12:
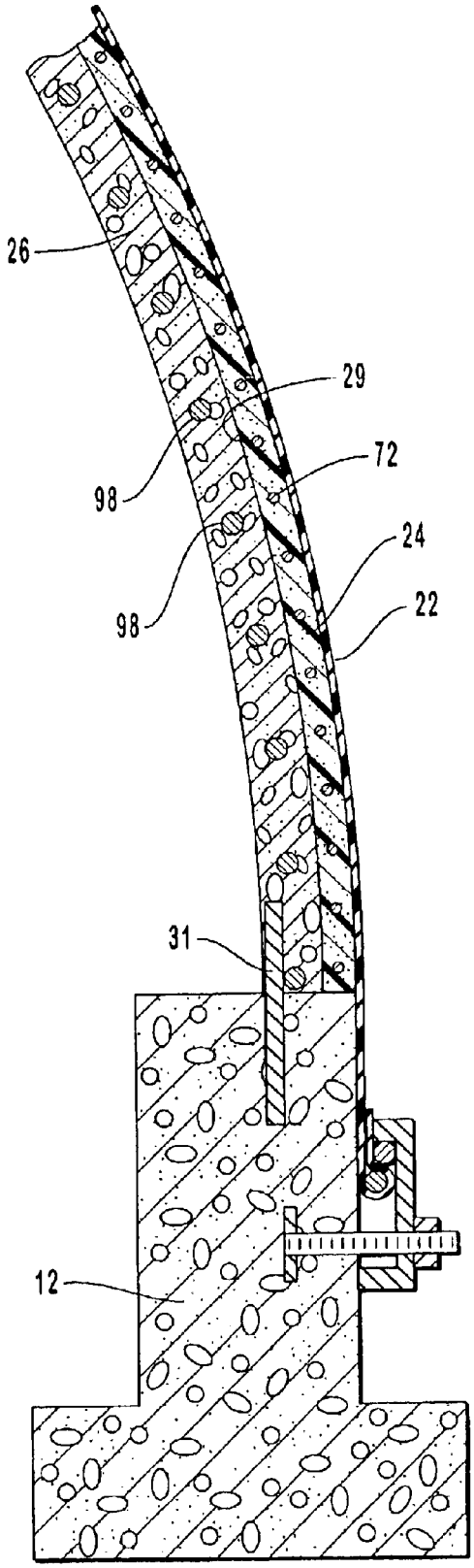
FIG. 12 is a cross section side view of the building shown in FIG. 11 with a support layer covering the reinforcing mat.

As depicted in FIG. 12, once reinforcing mat 98 has been positioned, a support layer 26 is formed so as to cover interior surface 29 of stabilizing layer 24 and reinforcing mat 98. In this regard, reinforcing mat 98 functions as reinforcing for support layer 26. As support layer 26 is built-up adjacent the footing 12, support layer will also cover reinforcing rods 31 projecting from footing 12, thereby fixing support layer 26 to footing 12.

Support layer 26 is typically comprised of a cementitious material. As used in the specification and appended claims, the term "cementitious material" is intended to include any material that includes cement. Cementitious materials typically include graded sand and/or any number of conventional additives such as fillers, fibers, hardeners, chemical additives or others with function to improve properties relating to strength, finishing, spraying, curing, and the like. In one embodiment, the cementitious material comprises sprayable, commercially available cementitious material such as "Gunite" or "Shotcrete". Stabilizing layer 24 can also be made of non-cementitious materials as long as they provide the required strength properties.

For efficiency, it is desirable that the material for support layer 26 be sprayable. For example, the cementitious material can be applied through a hose at high velocity which results in dense material having a cured compressive strength in a range between about 3,000 psi to about 10,000 psi. Alternatively, support layer 26 can be applied by hand, such as by use of a trowel, or other techniques.

Support layer 26 may be formed as a single application layer or as multiple overlapping sub-layers. For example, in one embodiment a first support sub-layer is formed over stabilizing layer 24 prior to the attachment of reinforcing mat 98. Once first support sub-layer is formed, reinforcing mat 98 is formed thereon. A second support sub-layer is then applied over the first support sub-layer so as to embed reinforcing mat 98 therebetween.

The various sub-layers of support layer 26 can be comprised of the same or different materials. Likewise, cementitious materials of different grade or properties can be used. Although not required, each successive sub-layer of support layer 26 is typically applied before the previous sub-layer is allowed to cure completely so as to effect maximum bonding between the successive sub-layers. The thickness of support layer 26 is in part dependent upon the size and configuration of building 10 and whether other layers or support structures are to be added.

Figure 13:
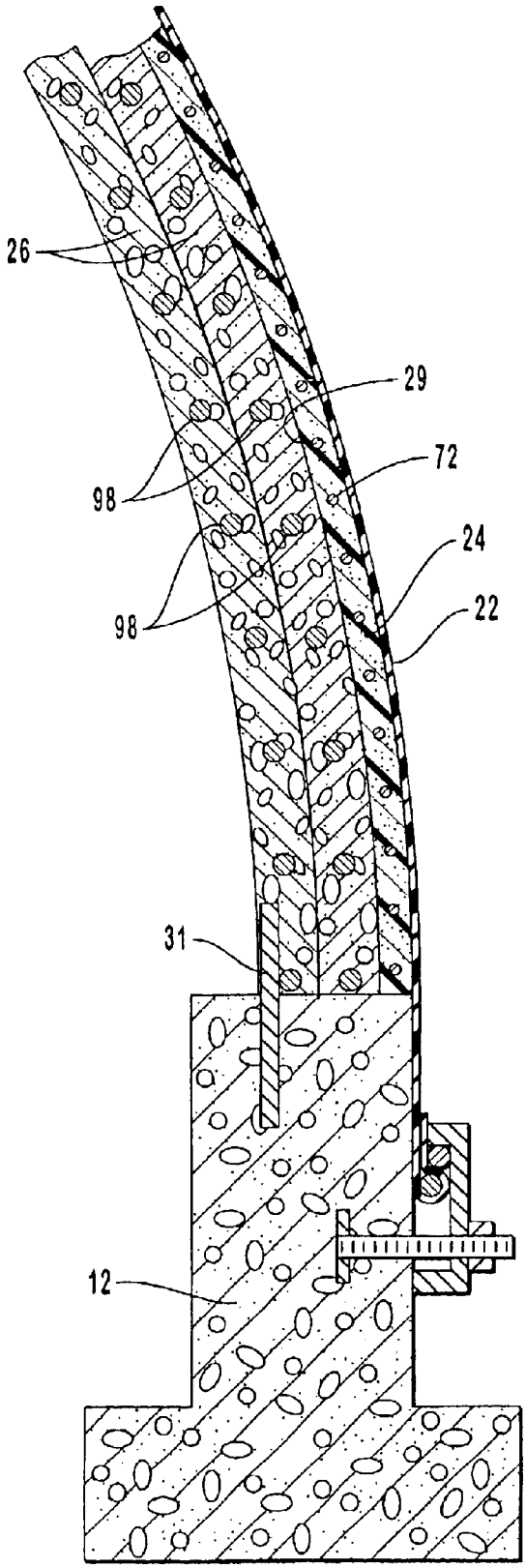
FIG. 13 is a cross sectional side view of the building shown in FIG. 12 with a second support layer.

It will be appreciated that two or more support layers 26 may be formed in building structure 10 so that building 10 has sufficient structural strength. As shown in FIG. 13, two support layers 26 are shown having a reinforcing mat 98 embedded in each support layer 26. As described above, additional hangers 58 can be secured in each support layer 26 to secure subsequent reinforcing mats 98. It is appreciated that the type of reinforcing mat 98 may differ between different support layers 26. Furthermore, the type of reinforcing mat 98 and number of support layers 26 will vary depending on the engineering requirements of the particular building structure 10.

As previously discussed, although not required, in one embodiment as the various layers or materials are added to building 10, the air pressure within chamber 20 is periodically increased so as to compensate for the load produced by the added weight. This increase in pressure can be accomplished in one or more stages. Once all of the layers are applied and cured to the extent necessary to provide the independent support strength, blower 57 is turned off and disconnected from building 10.

After completing building 10 thus far described, the various doorways, windows, and other openings can be cut through boundary wall 14. Inflatable form 22 may be removed from stabilizing layer 24 and a protective coating such as asphalt and/or a suitable paint can be applied over stabilizing layer 24 to protect it from moisture and ultraviolet degradation caused by exposure to the sun. Inflatable form 22 may then be reused. Alternatively, inflatable form 22 may be retained on the completed building 10 and, if desired, coated to provide additional protection to building 10. A further alternative is to remove form 22, apply a coating of cementitious material to the lower outer exposed portion of stabilizing layer 24 followed by a moisture barrier coating of asphalt over the entire structure and a final coating of paint for obtaining the desired appearance.

VIII. Ribs

Figure 14:
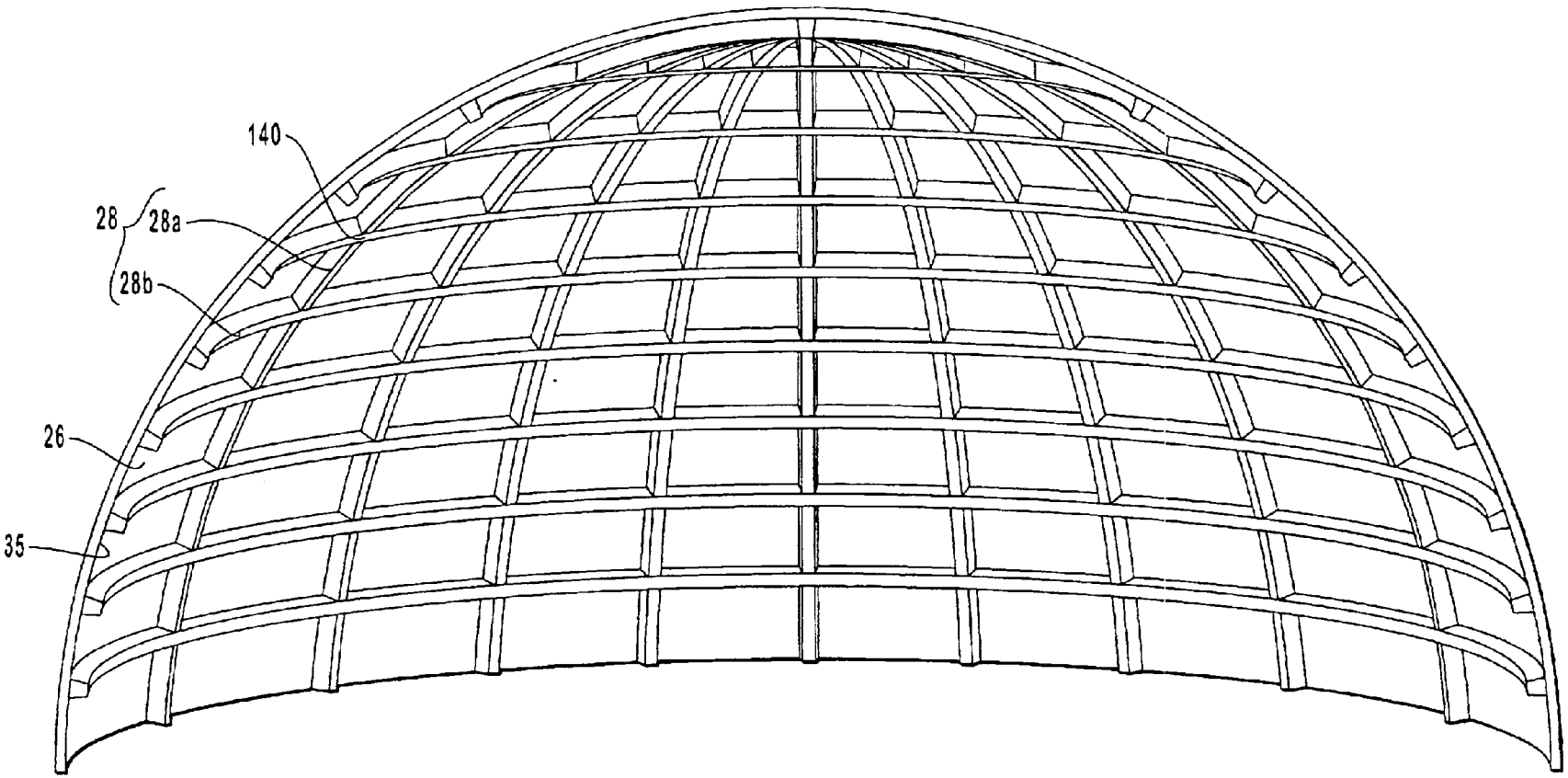
FIG. 14 is a cross sectional side view of a building having ribs formed thereon.

In one embodiment as discussed above, building 10 can be formed by simply completing the formation of one or more support layers 26. In an alternative embodiment, particularly in vary large buildings, one or more of the additional support layers 26 can be replaced with ribs. As depicted in FIG. 14, ribs 28 are formed on the interior surface of a support layer 26. Ribs 28 increase the structural strength of building 10 without adding the weight of an entire new support layer 26 with corresponding reinforcing mat 98.

Ribs 28 are shown comprising spaced apart vertical ribs 28*a* that vertically extend from footing 12 to the top of building structure 10 and spaced apart horizontal ribs 28*b* that encircle building structure 10. Vertical ribs 28*a* and horizontal ribs 28*b* integrally connect at joints 140. In alternative embodiments, ribs 28 can be formed on support layer 26 in a variety of different interconnected or separated patterns. For example, ribs 28 can be configured in interconnected polygonal shapes having three, five, or more sides.

Figure 15:
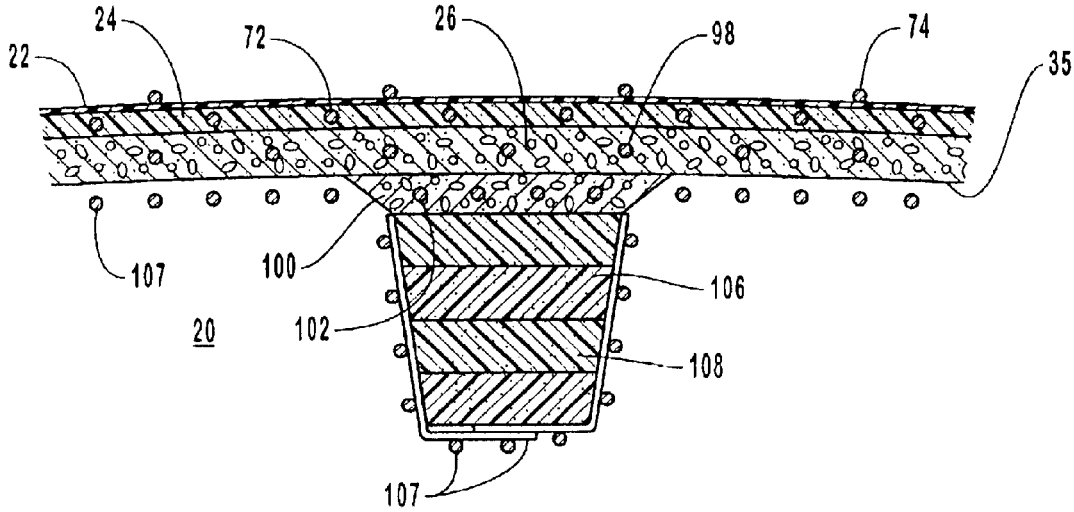
FIG. 15 is a cross sectional side view of a partially assembled rib.

In one embodiment, as depicted in FIG. 15, building 10 having reinforcing ribs 28 is produced by initially forming form 22, stabilizing layer 24, and one or more support layers 26 with reinforcing mat 98 embedded therein as previously discussed. Although not necessarily required, reinforcing line 72 and/or retention assembly 74 can also be used to enable selective increasing of the air pressure within chamber 20.

Once support layer 26 is formed, markings are made on interior surface 35 thereof identifying the position for the plurality of ribs 28. A base layer 100 is next formed that substantially extends the width and length of each rib 28. Base layer 100 is formed by initially mounting a reinforcing mat 102 adjacent to the interior surface of support layer 26 along the length of the rib. Reinforcing mat 102 comprises the same materials and alternatives as previously discussed with regard to reinforcing mat 98 and is also held in position by hangers 58. Base layer 100 in then applied over reinforcing mat 98. Base layer 100 is typically comprised of the same material and alternatives as previously discussed with regard to support layer 26 and is generally a cementitious material that is sprayed onto and over reinforcing mat 102.

Figure 16:
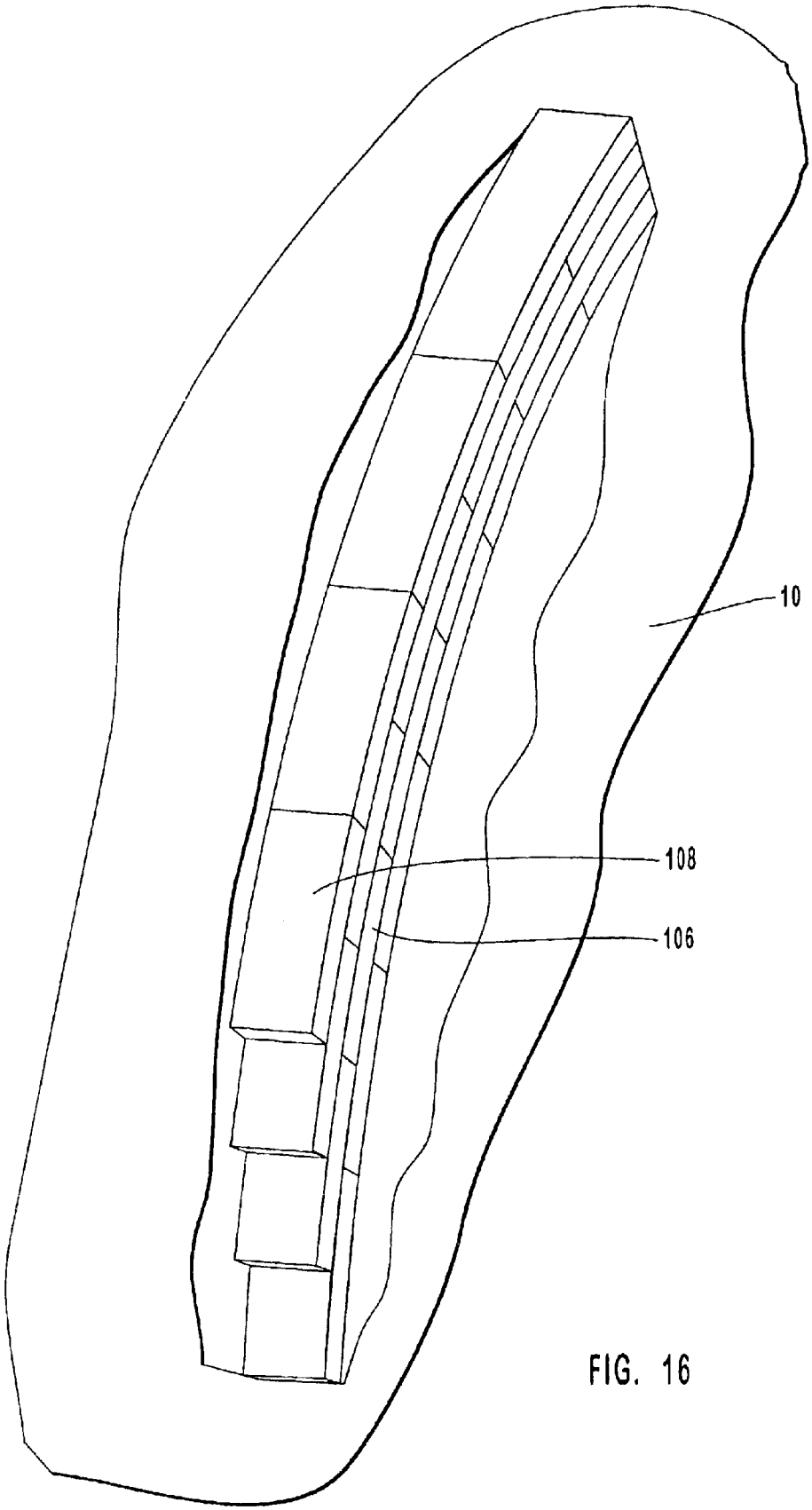
FIG. 16 is a partially cut away view of a building showing stacked blocks forming a core of a rib shown in FIG. 15.

Next, a foam core 106 comprised of a polymeric foam is formed on base layer 100. In one embodiment, as depicted in FIGS. 15 and 16, foam core 106 comprises a plurality of overlapping foam blocks 108 which are secured to base layer 100 and to each other such as by an adhesive, hangers, and/or ties. Foam blocks 108 can be comprised of Styrofoam or other types of expanded foam or lightweight material. In one embodiment, foam core 106 has a substantially trapezoidal transverse cross section. In an alternative embodiment, the transverse cross section can be triangular, square, rectangular, irregular, or any other desired configuration. It is appreciated that in alternative embodiment, base layer 100 is not required and that foam core 106 can be mounted directly on support layer 26.

As shown in FIG. 15, once foam core 106 is positioned on base layer 100, a reinforcing mat 107 is positioned along the length of each side of foam core 106 and transversely around foam core 106. Reinforcing mat 107 is held against or slightly spaced apart from foam core 106 by hangers, ties, or other conventional fasteners mounted to core 106. Reinforcing mat 107 is also disposed adjacent to interior surface 35 of support layer 26 in the same fashion as if a second support layer 26 was being formed.

Figure 17:
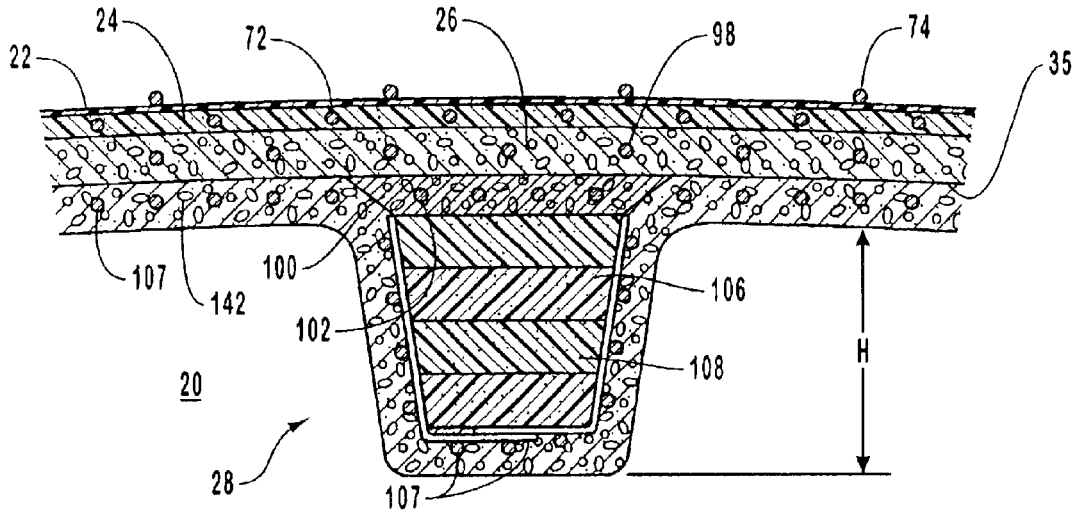
FIG. 17 is a cross sectional side view of the rib shown in FIG. 15 in a completed state.

Next, as depicted in FIG. 17, a finish layer 142 is applied over reinforcing mat 107 so as to cover foam core 106 and support layer 26. Reinforcing mat 107 is embedded within finish layer 142 so as to provide reinforcing thereto. Finish layer 142 is typically comprised of the same material and alternatives as previously discussed with regard to support layer 26 and is generally a cementitious material that is sprayed. Of course the size of rib 28 depends upon the engineered building parameters. In one embodiment, however, the completed ribs 28 have an exposed height H in a range between about 25 cm to about 125 cm.

It is appreciated that finish layer 142 can be applied in a variety of different acts and configurations. For example, a first finish layer can simply be applied over foam core 106. A second finish layer can then be applied over just the exposed portion of support layer 26 or over the combination of support layer 26 and the first finish layer.

The arrangement and number of ribs 28 will vary depending on the size of building 10 and other conventional engineering parameters. Furthermore, it is appreciated that the spacing and size of ribs 28 can vary at different locations on building 10. One of the benefits of using foam core 106, as oppose to making ribs 28 completely out of cementitious material, is that ribs 28 can be relatively large which increases their structural effectiveness while minimizing their weight.

As with the other embodiments, as ribs 28 are built-up by successive layers, the air pressure within chamber 22 can be increased to offset the added weight. In one embodiment, it is appreciated that the increase in pressure from inflation of form 22 to completion of building 10 can be in a range between about 1–4 inches $H_2O$ static pressure. This range can also be larger or smaller and depends on the parameters of building 10. By making ribs 28 as light as possible, the air pressure increase within chamber 22 is minimized, thereby minimizing any risk of failure of form 22.

Figure 18:
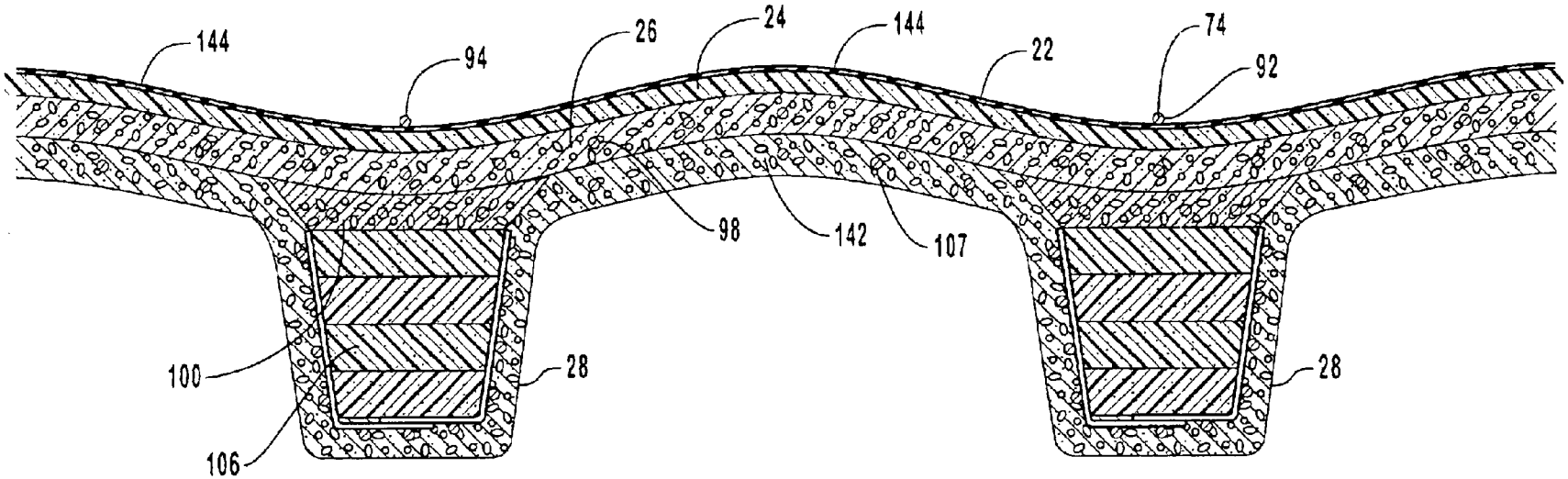
FIG. 18 is a cross sectional side view of a boundary wall of a building wherein a retention assembly as been mounted on the exterior surface thereof.

Turning now to FIG. 18, retention assembly 74 is used in association with the manufacture and positioning of reinforcing ribs 28. Specifically, as the radius of curvature of building 10 increases, the top of building 10 become relatively flat, thereby minimizing the structural strength characteristics of the dome configuration at that location. By using retention assembly 74 as previously discussed, inflated form 22 bulges out between spaced apart retention lines 94. This bulging out of form 22 causes form 22 to produce a plurality of smaller sub-domes 144 which are bounded between corresponding retention lines 94. As subsequent stabilizing and support layers are applied, the layers follow the same curvature as form 22. Accordingly, sub-domes 144 can be used to provide multiple domed curvatures on the top of building 10 which domed curvature increase the structural strength of building 10.

Although not required, in the embodiment shown in FIG. 18, ribs 28 are places in complementary alignment with retention lines 94 of retention assembly 74. In addition to the use of retention assembly 74, retaining line 72 can also be used as previously discussed.

Figure 19:
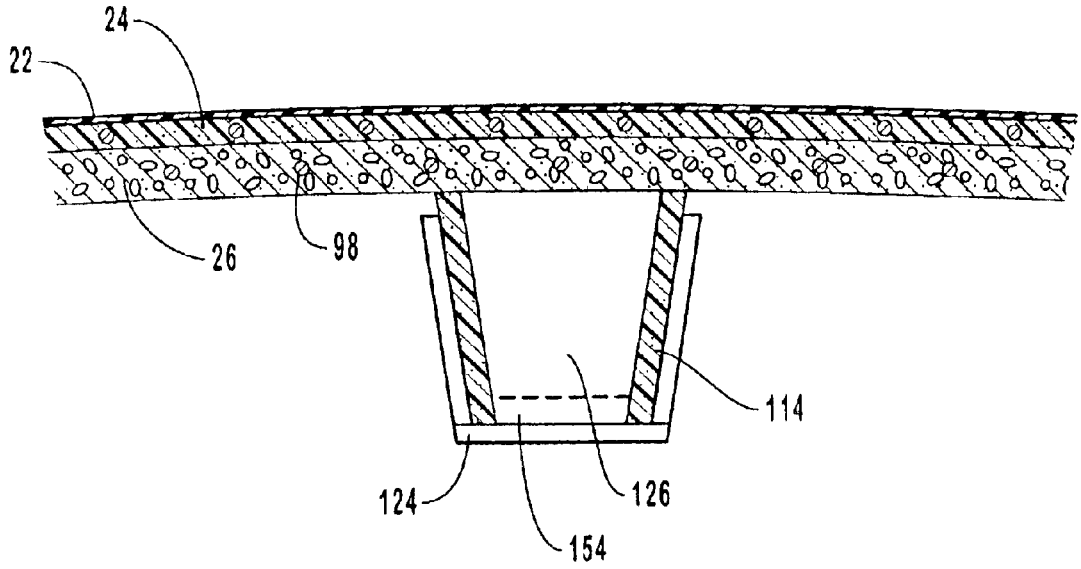
FIG. 19 is a cross sectional side view of a boundary wall having a rib form mounted thereon.
Figure 20:
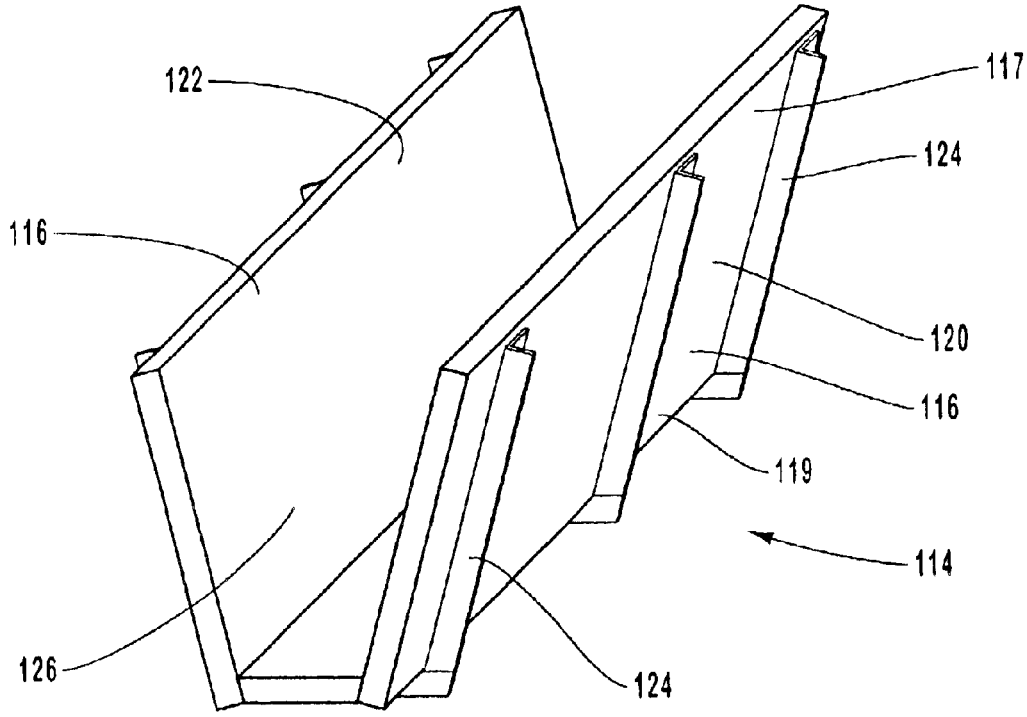
FIG. 20 is a perspective view of the form shown in FIG. 19.
Figure 21:
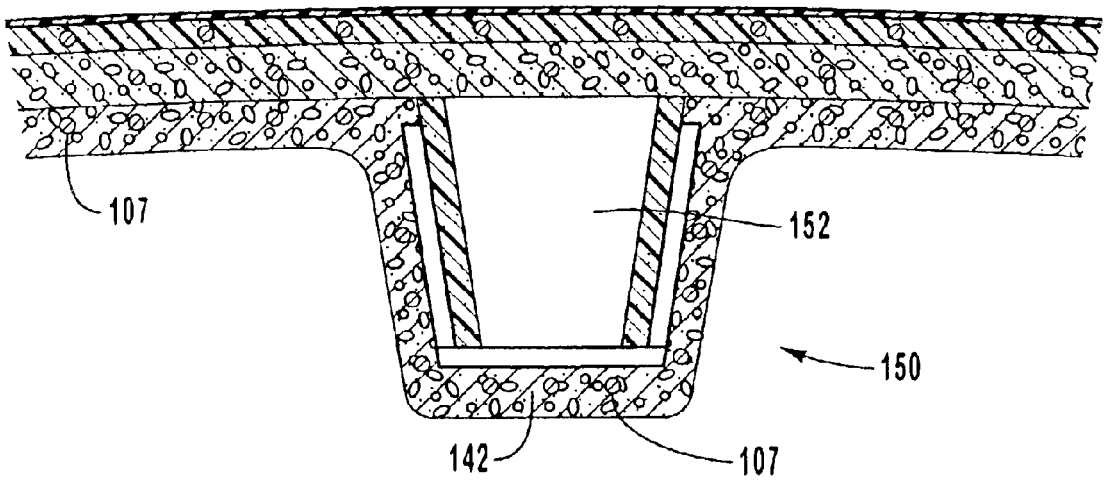
FIG. 21 is a cross sectional side view of the completed rib shown in FIG. 19.

FIGS. 19–21 show an alternative method for forming ribs 150 having a foam core 152. As shown in FIGS. 19 and 20, a plurality of elongated forms 114 are secured on interior surface 35 of support layer 26 along the intended length for each rib 150. Forms are held in place using conventional hangers or ties as previously discussed. If desired, base layer 100 can be formed between forms 114 and support layer 26. Each form 114 has an open sided substantially trapezoidal transverse cross section. Specifically, form 114 comprises a pair of spaced apart planar side walls 116 that inwardly slope toward each other from a top end 117 toward a bottom end 119. Each side wall 116 has an exterior surface 120 and an interior surface 122. Side walls 116 are held in place by a plurality of brackets 124 mounted on exterior surface 120 of side walls 116 and extending between side walls 116 at bottom end 119. (As with the other embodiments, depending on design parameters, either, both, or neither of retention assembly 74 and reinforcing lines 72 can be used.)

To minimize the weight of form 114, in one embodiment side walls 116 are formed of a light-weight, light-density material such as, but not limited to, foam, styrofoam, plastic, corkboard, and the like. Alternatively, side walls 116 can be formed of any planer material such as plywood or a sheet of metal. Brackets 124 can also be made of any material, but in one embodiment are made of metal.

Bounded between side walls 116 is an open channel 126. In the embodiment depicted, channel 126 is substantially open at both top end 117 and bottom end 119. As depicted in FIG. 21, once form 114 is secured to base layer 100, channel 120 is filled with an polymeric foam, such as polyurethane, so as to form foam core 152. In one embodiment, the polymeric foam is simply sprayed into channel 126 through open bottom end 119. In an alternative embodiment, an end wall 154 depicted by the dashed lines in FIG. 19 extends between side walls 116 at bottom end 119. In this configuration, end wall 154 closes off access to channel 120 along bottom end 119. Polymeric form is then pumped into bounded channel 120 through one or more openings formed on form 114 so as to form foam core 152.

Next, reinforcing mat 107 is secured adjacent to the exterior of form 114 and support layer 26. Finish layer 142 is then applied over form 114 and support layer 26 so as to embed reinforcing mat 107 therein and complete the formation of ribs 150. As previously discussed with other embodiments, finish layer 142 can be applied over support layer 26 and form 114 in different steps and layers. As with the other embodiments, depending on design parameters, either, both, or neither of retention assembly 74 and reinforcing lines 72 can also be used.

Figure 22:
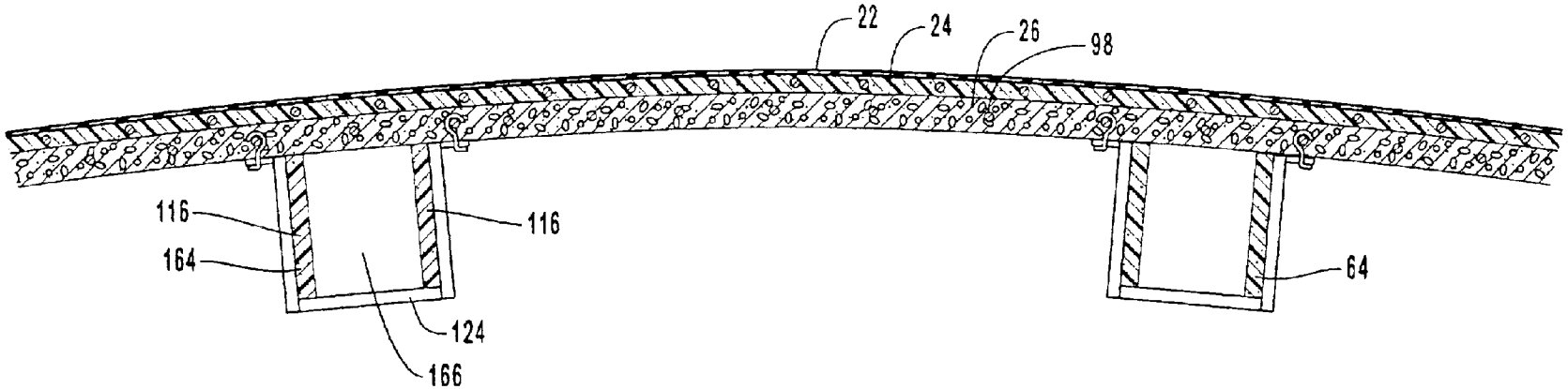
FIGS. 22–25 are cross sectional side views show sequential steps in the manufacture of an alternative rib configuration.

FIGS. 22–25 depict yet another method for forming alternative ribs 160 having a foam core 162. As shown in FIG. 22, mounted on support layer 26 at the location for each rib 160 is a form 164. Form 164 is substantially identical to form 114 as previously discussed except that side wall 116 are disposed in parallel alignment as opposed to an inwardly sloping alignment. In an alternative embodiment, however, one or more of side walls 116 can also be sloping. Side walls 116 bound a channel 166 therebetween and are held in position by brackets 124. In turn, form 164 is secured to support layer 26 using conventional ties or hangers. The components of form 164 can be made of the same materials and alternatives as discussed with form 114. The size and positioning of channels 166 depends on the engineering parameters for building 10. In one embodiment, however, channel 166 typically has a width in a range between about 15 cm to about 60 cm and a depth in a range between about 10 cm to about 125 cm.

Figure 23:
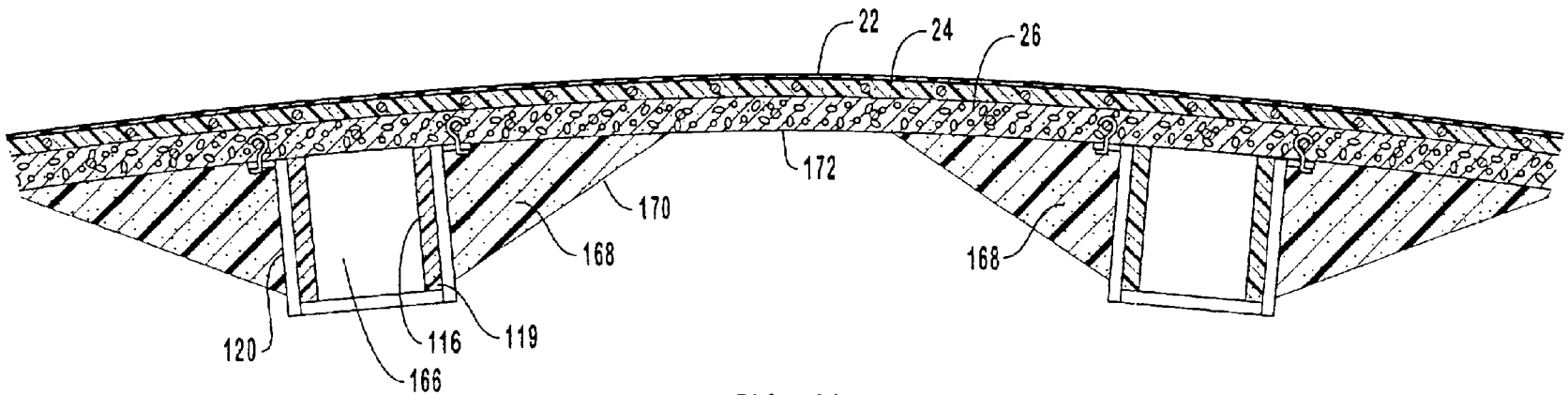

As depicted in FIG. 23, a longitudinally extending shoulder 168 having a substantially triangular transverse cross section is formed at the intersection of the exterior surface 120 of each side wall 116 and support layer 26. Each should 168 has an exposed transition surface 170 that extends at a slope from bottom end 119 of side wall 116 to support layer 26. It is noted that were adjacent ribs 160 are being formed, shoulders 168 are spaced apart so that a portion 172 of support layer 26 remains exposed between adjacent shoulders 168. In one embodiment, shoulders 168 are formed by spraying on a polymeric foam such as polyurethane foam. Alternatively, shoulders 168 can be formed of one or more blocks of foam or other light weight material that are secured in place using conventional methods such as adhesive, ties, and/or hangers.

Figure 24:
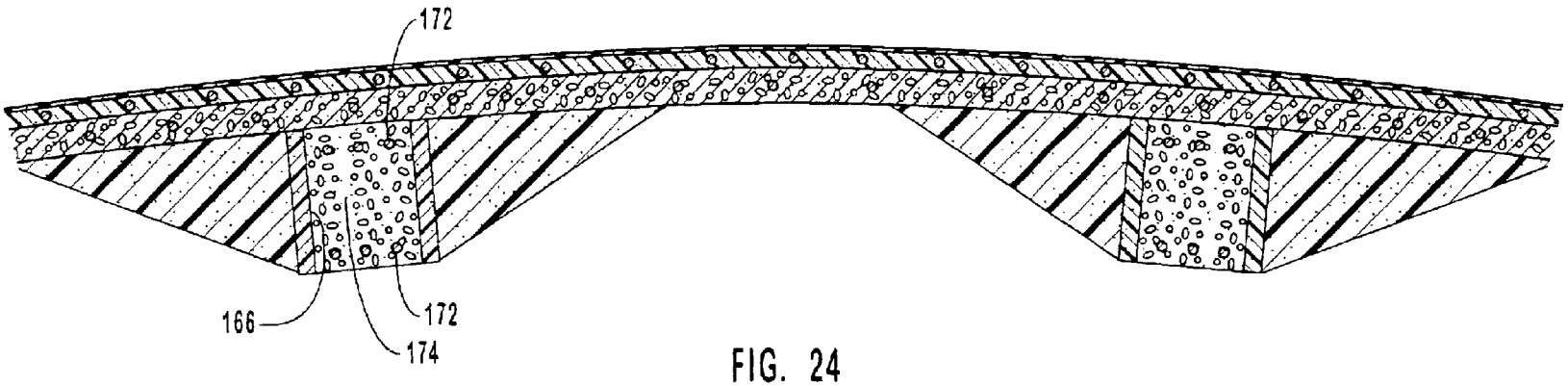

Turning now to FIG. 24, one or more spaced apart layers of reinforcing mat 172 are next positioned within channel 166. Channel 166 is then filled with a cementitious material so as to form an elongated strut 174 having a substantially square or rectangular transverse cross section. It is appreciated that reinforcing mat 172 and the cementitious material can be positioned in one or more applications or layers.

Figure 25:
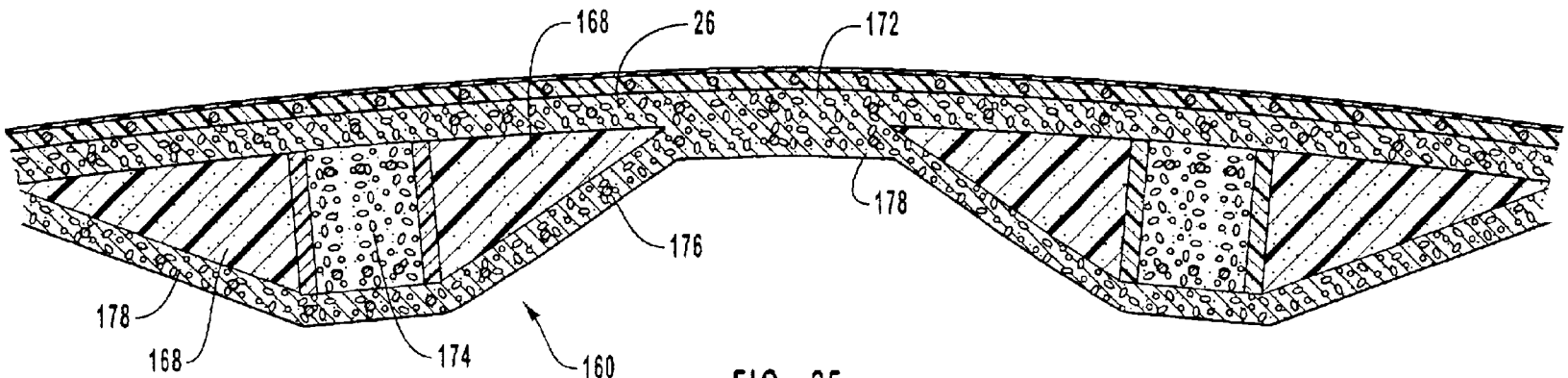

As depicted in FIG. 25, once strut 174 is formed, a reinforcing mat 176 is positioned adjacent to strut 174, shoulders 168, and portion 172 of support layer 26. A finish layer 178 is then applied over reinforcing mat 176 so as to complete the formation of ribs 160. It is appreciated that completed ribs 160 comprise a substantially I-beam portion which includes strut 174 extending between support layer 26 and finish layer 178. This I-beam configuration adds increased structural strength to boundary wall 14 of building 10. At the same time, ribs 160 comprise two foam cores, i.e, shoulders 168 and, where applicable, side walls 116, which minimize the weight ribs 160.

IIX. Completed Building

Figure 26:
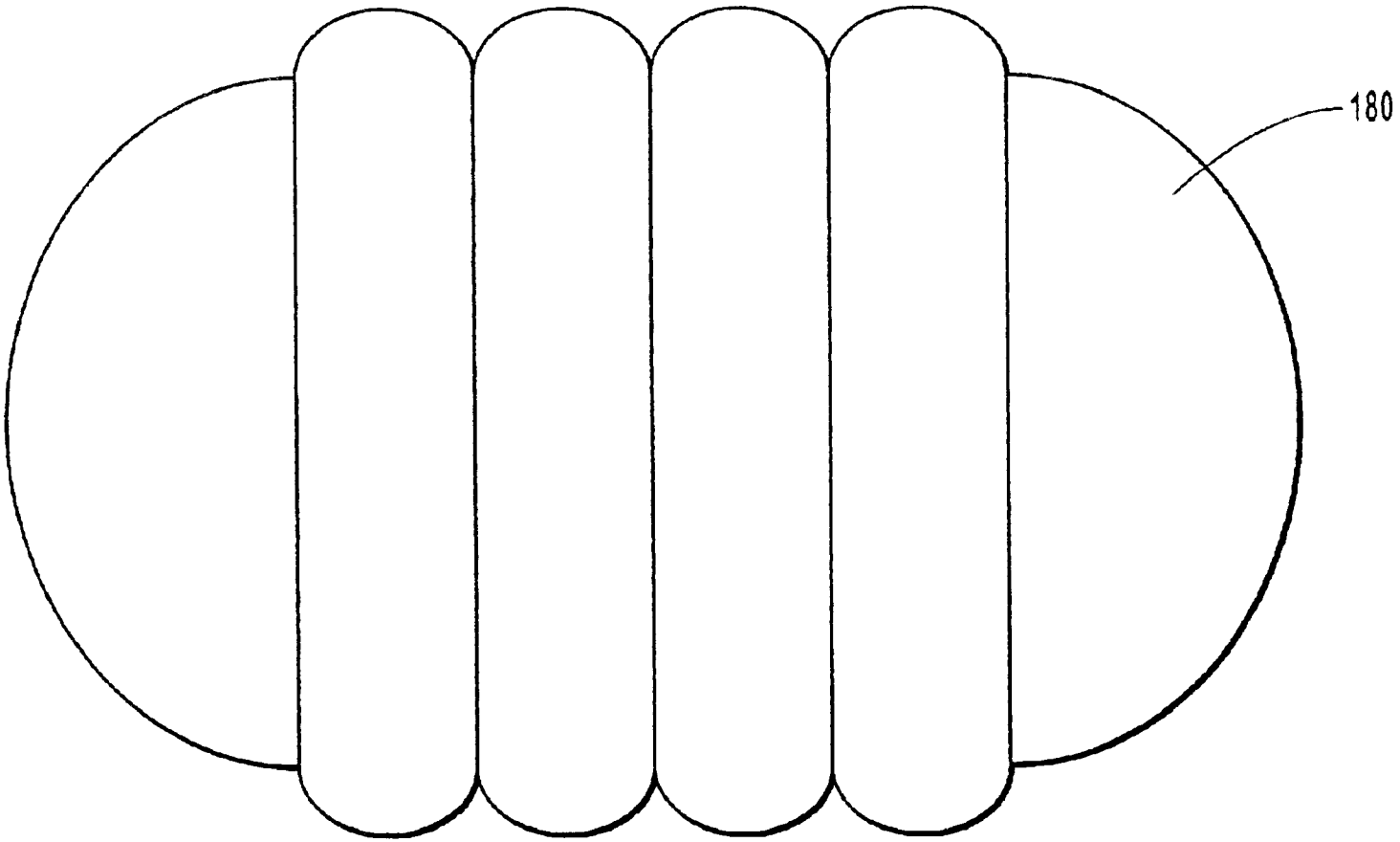
FIG. 26 is a top plan view of a building having compound curves.

Once the ribs are formed and sufficiently cured, the pressure within chamber 22 can be released and both the interior and exterior of building 10 completed as previously discussed above in section VII. Building 10, while being illustrated as a circular dome shaped structure, may take alternative configurations such as a barrel shell shape, an elliptical shape, a rectangular shape, or any other desired configuration. Alternatively, as depicted in FIG. 26, a building 180 configured having compound curves, i.e., a "caterpillar" shape). The methods of construction in accordance with the present invention facilitate the construction of buildings of substantial size. For example, the illustrated domed building structure 10 may have a base diameter in a range from about 30 meters to about 350 meters.

The present invention may be embodied in other specific forms without departing from its spirit or essential characteristics. For example, a number of methods and alternative structures and disclosed herein. It is appreciated that features of different methods and structures can be mixed and matched to form new methods and structures. As such, the described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A building comprising:

an inflatable form having an interior surface;

a stabilizing layer disposed on the interior surface of the inflatable form, the stabilizing layer being comprised of a polymeric foam; and reinforcing line being at least partially embedded within and along the stabilizing layer so as to reinforce the stabilizing layer against outward expansion, the reinforcing line being mechanically connected to the stabilizing layer at at least two spaced apart locations along the reinforcing line.

2. A building as recited in claim 1, wherein the inflatable form is comprised of a polymeric material.

3. A building as recited in claim 1, wherein at least a portion of the inflatable form has a substantially dome shaped configuration.

4. A building as recited in claim 1, wherein the stabilizing layer is comprised of polyurethane.

5. A building as recited in claim 1, wherein the reinforcing line comprises horizontally and vertically disposed strands of reinforcing line.

6. A building as recited in claim 1, wherein the reinforcing line comprises wire having a tensile strength in a range between about 20,000 psi to about 200,000 psi.

7. A building as recited in claim 1, further comprising at least one support layer disposed on the interior surface of the stabilizing layer, the support layer having an interior surface and being comprised of a cementitious material.

8. A building as recited in claim 7, further comprising a reinforcing mat at least partially embedded within the support layer.

9. A building as recited in claim 7, further comprising a rib projecting from the interior surface of the support layer.

10. A building as recited in claim 9, wherein the rib has a exposed height in a range between about 25 cm to about 125 cm.

11. A building as recited in claim 9, wherein the rib comprises:

a core comprised of a polymeric foam; and a layer of cementitious material disposed over the core.

12. A building as recited in claim 7, further comprising a plurality of intersecting ribs projecting from the interior surface of the at least one support layer, each of the ribs comprising:

a core comprised of a polymeric foam; and a layer of cementitious material disposed over the core.

13. A building comprising:

an inflatable form having an interior surface;

a stabilizing layer disposed on the interior surface of the inflatable form, the stabilizing layer having an interior surface;

at least one support layer disposed on the interior surface of the stabilizing layer, the at least one support layer having an interior surface and being comprised of a cementitious material; and a rib projecting from the interior surface of the at least one support layer, the rib comprising:

a core comprised of a polymeric foam; and a layer of cementitious material disposed over the core.

14. A building as recited in claim 13, further comprising a reinforcing line at least partially embedded within and along the stabilizing layer.

15. A building as recited in claim 14, wherein the reinforcing line comprises horizontally and vertically disposed strands of reinforcing line.

16. A building as recited in claim 13, wherein the stabilizing layer is comprised of polyurethane.

17. A building as recited in claim 13, wherein the stabilizing layer is comprised of a cementitious material.

18. A building as recited in claim 13, wherein the rib has an exposed height in a range between about 15 cm to about 125 cm.

19. A building as recited in claim 13, wherein the core of the rib is mounted directly against the interior surface of the at least one support layer.

20. A building as recited in claim 13, wherein a base layer comprised of cementitious material is disposed between the core of the rib and the interior surface of the at least one support layer.

21. A building as recited in claim 13, wherein a form is at least partially disposed between the core of the rib and the layer of cementitious material disposed over the core.

22. A building as recited in claim 13, wherein the rib further comprises:

a strut projecting from the interior surface of the at least one support layer, the strut having a first side and an opposing second side; and the core comprising a first core disposed on the first side of the strut and a second core disposed on the second side of the strut.

23. A building as recited in claim 22, wherein at least the first core or the second core has a substantially triangular transverse cross section.

24. A building as recited in claim 13, further comprising a plurality of intersecting ribs projecting from the interior surface of the at least one support layer, each of the ribs comprising:

a core comprised of a polymeric foam; and a layer of cementitious material disposed over the core.

25. A building comprising:

an inflatable form having an interior surface;

at least one stabilizing layer disposed on the interior surface of the inflatable form, the at least one stabilizing layer having an interior surface;

at least one support layer disposed on the interior surface of the at least one stabilizing layer, the at least one support layer having an interior surface and being comprised of a cementitious material; and a rib projecting from the interior surface of the at least one support layer, the rib comprising:

a strut projecting from the interior surface of the at least one support layer, the strut having a first side and an opposing second side;

a first core disposed on the first side of the strut and a second core disposed on the second side of the strut, the first core and the second core each being comprised of a polymeric foam; and a layer of cementitious material disposed over the strut, first core, and second core.

26. A building as recited in claim 25, wherein at least the first core or the second core has a substantially triangular transverse cross section.

27. A building as recited in claim 25, further comprising reinforcing line at least partially embedded within the at least one stabilizing layer.

28. A building as recited in claim 25, wherein the at least one stabilizing layer is comprised of a polymeric foam or a cementitious material.

29. A building comprising:

a boundary wall having an interior surface bounding a chamber, the boundary wall being comprised of a cementitious material, at least a portion of the boundary wall having a substantially dome-shaped configuration; and a plurality of ribs inwardly projecting from the interior surface of the boundary wall, each rib comprising:

a core comprised of a polymeric foam; and a layer of cementitious material disposed over the core.

30. A building as recited in claim 29, wherein the layer of cementitious material disposed over the core of each rib also extends over at least a portion of the interior surface of the boundary wall.

31. A building as recited in claim 29, wherein each rib further comprises:

a strut projecting from the interior surface of the boundary wall, the strut having a first side and an opposing second side; and the core comprising a first core disposed on the first side of the strut and a second core disposed on the second side of the strut, the layer of cementitious material being disposed over the strut, first core, and second core.

32. A building as recited in claim 1, further comprising a plurality of spaced apart hangers secured to and projecting from the stabilizing layer.

33. A building as recited in claim 1, wherein discrete line hangers are used to mechanically connect the reinforcing line to the stabilizing layer.

34. A building as recited in claim 1, wherein the reinforcing line is tensioned.

35. A building as recited in claim 1, wherein the stabilizing layer comprises a first sub-layer disposed on the inflatable form and a second sub-layer disposed over the first sub-layer, the first sub-layer and the second sub-layer each being comprised of a polymeric foam, the reinforcing line being disposed between the first sub-layer and the second sub-layer.

36. A building as recited in claim 1, wherein the reinforcing line is mechanically connected to the stabilizing layer at at least three spaced apart locations along the reinforcing line.

37. A building comprising:

an inflatable form having an interior surface;

a stabilizing layer disposed on the interior surface of the inflatable form, the stabilizing layer comprising a first sub-layer disposed on the inflatable form and having an interior surface and a second sub-layer disposed over the interior surface of the first sub-layer, the first sub-layer and the second sub-layer each being comprised of a polymeric foam; and an elongated strand of reinforcing line extending longitudinally along the interior surface at the first sub-layer and enclosed between the first sub-layer and the second sub-layer.

* * * * *